US012735148B2

(12) United States Patent
Yu et al.

(10) Patent No.: US 12,735,148 B2
(45) Date of Patent: Sep. 15, 2026

(54) MOORING SYSTEM AND PROCESSES FOR USING SAME

(71) Applicant: MODEC AMERICA, INC., Houston, TX (US)

(72) Inventors: Hao Yu, Katy, TX (US); Arun Sanjay Duggal, Houston, TX (US); Stephen P. Lindblade, Waller, TX (US); Sjoerd Jan Wichers, Spring, TX (US); Yonghui Liu, Houston, TX (US); Yu Ding, Houston, TX (US); Dipak Jayvant Chavda, Sugar Land, TX (US)

(73) Assignee: MODEC AMERICA, INC., Houston, TX (US)

( * ) Notice: Subject to any disclaimer, the term of this patent is extended or adjusted under 35 U.S.C. 154(b) by 662 days.

(21) Appl. No.: 18/167,564

(22) Filed: Feb. 10, 2023

(65) Prior Publication Data

US 2023/0257074 A1 Aug. 17, 2023

Related U.S. Application Data

(60) Provisional application No. 63/309,412, filed on Feb. 11, 2022.

(51) Int. Cl.
*B63B 21/16* (2006.01)
*B63B 21/00* (2006.01)

(52) U.S. Cl.
CPC ..... *B63B 21/16* (2013.01); *B63B 2021/002* (2013.01)

(58) Field of Classification Search
CPC ..... B63B 21/00; B63B 2021/001; B63B 2021/002; B63B 2021/003;
(Continued)

(56) References Cited

U.S. PATENT DOCUMENTS 4,490,121 A 12/1984 Coppens et al.
4,533,332 A * 8/1985 Coppens ..... B63B 21/50 441/3
(Continued)

FOREIGN PATENT DOCUMENTS

EP 0597595 A1 5/1994
EP 2933182 A1 10/2015

OTHER PUBLICATIONS

International Search Report and Written Opinion of the International Searching Authority dated Jun. 6, 2023, for PCT/US2023/062300.

*Primary Examiner* — Daniel V Venne
(74) *Attorney, Agent, or Firm* — Edmonds & Cmaidalka, P.C.

(57) ABSTRACT

A mooring system for mooring a vessel floating on a surface of a body of water. In some embodiments, the system can include a base structure configured to be secured to a seabed, a yoke configured to be pivotably connected at a first end to the base structure about an axis of the base structure, a weight connected to the yoke, a turntable that can include a rotating part configured to be disposed on the vessel and a fixed part, a link arm that can include a first end configured to be connected to a second end of the yoke and/or the weight and a second end configured to be connected to the fixed part of the turntable such that the vessel is rotatable with respect to the link arm about a central axis of the turntable.

20 Claims, 22 Drawing Sheets

(58) Field of Classification Search
CPC . B63B 2021/501; B63B 21/508; B63B 21/20; B63B 2021/203; B63B 2021/206; B63B 2207/02; B63B 43/06
USPC ..... 114/230.1, 230.11, 230.12, 230.13, 114/230.14, 230.15
See application file for complete search history.

(56) References Cited

U.S. PATENT DOCUMENTS

| | | | | |
|---|---|---|---|---|
| 6,851,994 | B2 * | 2/2005 | Boatman | B63B 21/00 114/230.15 |
| 7,007,623 | B2 * | 3/2006 | Boatman | B63B 21/50 114/230.26 |
| 7,322,308 | B2 * | 1/2008 | De Baan | B63B 21/50 114/230.1 |
| 7,543,543 | B2 * | 6/2009 | Boatman | B63B 21/50 114/230.14 |
| 9,573,659 | B2 * | 2/2017 | Liu | B63B 21/00 |
| 11,267,532 | B2 * | 3/2022 | Yu | B63B 22/021 |
| 11,279,446 | B2 * | 3/2022 | Yu | B63B 21/507 |
| 11,305,843 | B2 * | 4/2022 | Hovde | B63B 27/08 |
| 2022/0001963 | A1 | 1/2022 | Duggal | |

* cited by examiner

MOORING SYSTEM AND PROCESSES FOR USING SAME

CROSS-REFERENCE TO RELATED APPLICATION

This application claims priority to U.S. Provisional Patent Application No. 63/309,412, filed on Feb. 11, 2022, which is incorporated by reference herein.

FIELD

Embodiments described generally relate to mooring systems and processes for using same. More particularly, such embodiments relate to a mooring systems for mooring a vessel floating on a surface of a body of water and processes for using same.

BACKGROUND

In the offshore oil and gas industry, mooring systems have been used for many years to moor a vessel on a surface of a body of water. In relatively shallow waters, for example less than 50 meters of water, traditional chain mooring systems are ineffective and typically yoke mooring systems are employed. The yoke mooring system can include a yoke that is above the surface of the water or below the surface of the water.

Mooring systems that include a yoke located below the surface of the water include complex mechanical systems located beneath the surface of the water to permit rotation of the vessel about a vertical axis with respect to a component of the mooring system. Locating these mechanical systems below the surface of the water is complex and expensive from a design, manufacturing and operating perspective.

There is a need, therefore, for improved mooring systems and processes for using same.

SUMMARY

Mooring systems and process for using same are provided. In some embodiments, the mooring system can include a base structure, a yoke, a weight, a turntable, and a link arm. The base structure can be configured to be secured to a seabed. The yoke can include a first end and a second end. The first end of the yoke can be configured to be connected to the base structure such that the yoke can be pivotable about an axis of the base structure. The weight can be connected to the yoke. The turntable can include a rotating part and a fixed part. The rotating part can be configured to be disposed on the vessel. The link arm can have a first end and a second end. The first end of the link arm can be configured to be connected to the second end of the yoke, the weight, or both the second end of the yoke and the weight. The second end of the link arm can be configured to be connected to the fixed part of the turntable such that the vessel can be rotatable with respect to the link arm about a central axis of the turntable.

In some embodiments, a process for mooring a vessel floating on a surface of a body water to a mooring system can include positioning the vessel near the mooring system. The mooring system can include a base structure, a yoke, a weight, a turntable, a link arm, a releasable connector, a lifting device, and a lifting line. The base structure can be secured to a seabed. The yoke can include a first end and a second end. The first end of the yoke can be connected to the base structure such that the yoke is pivotable about an axis of the base structure. The weight can be connected to the yoke. The turntable can include a rotating part and a fixed part. The rotating part can be disposed on the vessel. The link arm can include a first end and a second end. The first end of the link arm can be connected to the second end of the yoke, the weight, or both the second end of the yoke and the weight. The releasable connector can include a first component connected to the fixed part of the turntable and a second component connected to the second end of the link arm. The lifting device can be disposed on the vessel. The lifting line can include a first end connected to the second component of the connector. The process can also include connecting a second end of the lifting line to the lifting device. The process can also include hauling in the lifting line with the lifting device to lift the link arm, the yoke, and the weight to move the second component of the releasable connector into an engagement position with respect to the first component of the releasable connector. The process can also include connecting the first component of the releasable connector to the second component of the releasable connector to secure the vessel to the mooring system.

In some embodiments, a process for unmooring a vessel floating on a surface of a body of water from a mooring system can include disconnecting a first component from a second component of a releasable connector. The mooring system can include a base structure, a yoke, a weight, a turntable, a link arm, the releasable connector a lifting device, and a lifting line. The base structure can be secured to a seabed. The yoke can include a first end and a second end. The first end of the yoke can be connected to the base structure such that the yoke can be pivotable about an axis of the base structure. The weight can be connected to the yoke. The turntable can include a rotating part and a fixed part. The rotating part can be disposed on the vessel. The link arm can include a first end and a second end. The first end of the link arm can be connected to the second end of the yoke, the weight, or both the second end of the yoke and the weight. The first component of the releasable connector can be connected to the fixed part of the turntable and the second component of the releasable connector can be connected to the second end of the link arm. The lifting device can be disposed on the vessel. The lifting line can include a first end connected to the second component of the connector and a second end connected to the lifting device. The process can also include lowering the link arm, the yoke, and the weight toward the seabed with the lifting line and the lifting device. The process can also include disconnecting the second end of the lifting line from the lifting device. The process can also include maneuvering the vessel away from the mooring system.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
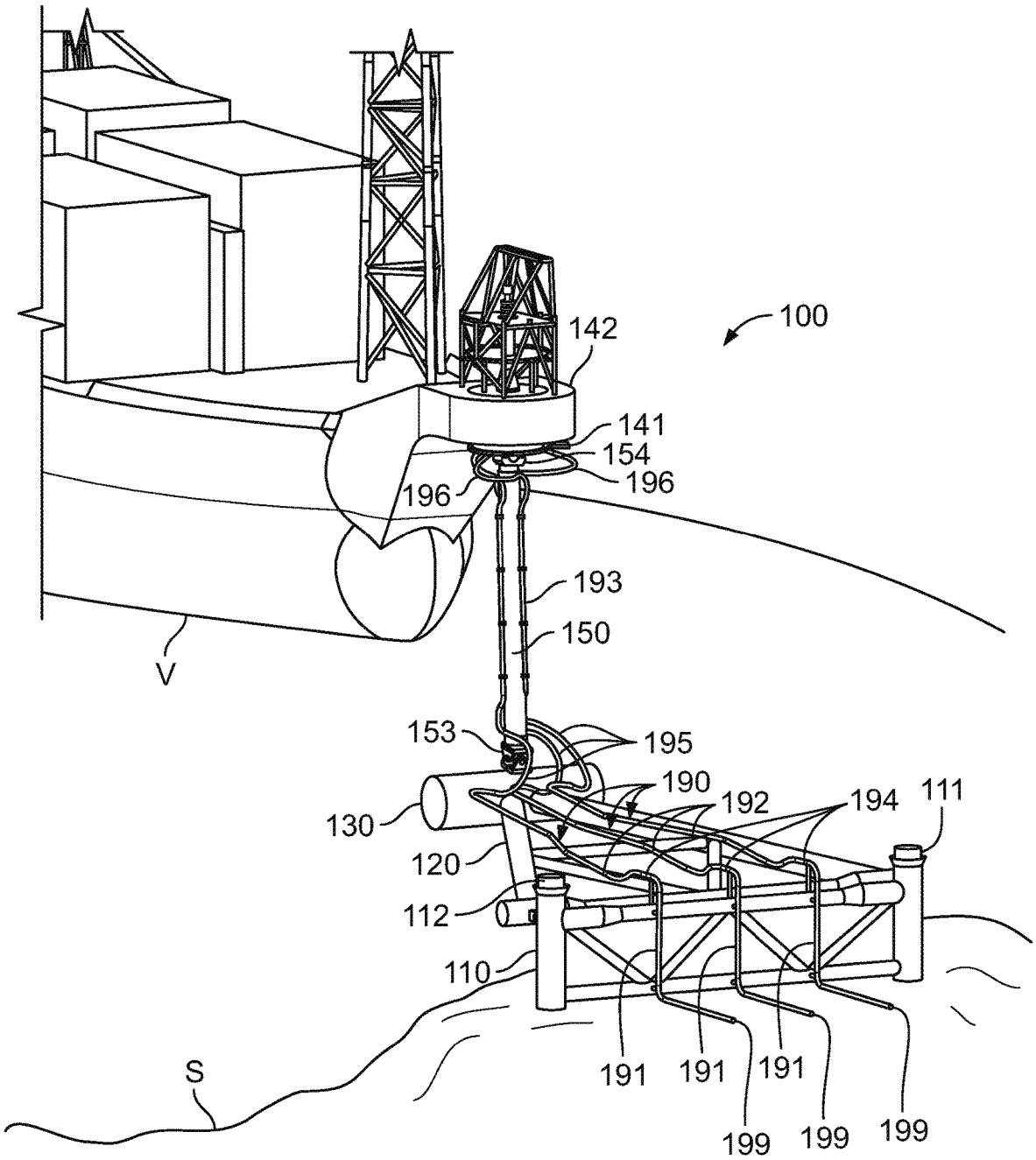
FIGS. 1 and 2 depict isometric views of an illustrative mooring system for mooring a vessel floating on a surface of a body of water, according to one or more embodiments described.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "include", "including", "comprise", and "comprising" are used in an open-ended fashion, and thus should be interpreted to mean "including, but not limited to." Also, as used herein the indefinite articles 'a' and 'an' should be interpreted to mean "at least one" or "one or more."

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and processes of using the same may be equally effective at various angles or orientations.

The terms "orthogonal" and "orthogonally", as used herein, refer to two lines or vectors that are not coplanar, i.e., skew lines, and, therefore, do not intersect but can appear to be perpendicular when viewed from a particular angle. Said another way, two skew lines or vectors can be said to be "orthogonal" if they form a 90 degree projected angle. For example, in a three dimensional cartesian coordinate system, a line parallel to the X-axis with a constant Z-value of 1 is orthogonal to a line parallel to the Y-axis with a constant Z-value of 2 because these lines will not intersect and the lines are orientated at 90 degrees with respect to one another when viewed along the Z-axis. As yet another example of a first line being orthogonal to a second line, the first line can lie in a first plane and the second line can lie in a second plane, where the first and second planes are parallel with respect to one another and the first line and the second line are oriented at 90 degrees with respect to one another when viewed along an axis that is normal to the first and second planes. Further, the term "substantially" when used in the context of "substantially orthogonal" means the first and second lines are orientated at angles of about 80 degrees, about 83 degrees, about 85 degrees, about 87 degrees, or about 89 degrees to, about 91 degrees, about 93 degrees, about 95 degrees, about 97 degrees, or about 100 degrees with respect to one another when viewed along an axis that is normal to the first and second planes.

The terms "perpendicular" and "perpendicularly", as used herein, refer to two lines or vectors that are coplanar and, therefore, do intersect one another at a 90 degree angle. Further, the term "substantially" when used in the context of "substantially perpendicular" means a first line and a second line are orientated at angles of about 80 degrees, about 83 degrees, about 85 degrees, about 87 degrees, or about 89 degrees to, about 91 degrees, about 93 degrees, about 95 degrees, about 97 degrees, or about 100 degrees with respect to one another. Further, the term "substantially" when used in the context of "substantially parallel" means an axis and a plane (e.g., the surface of a body of water) are orientated at angles of about 160 degrees, about 165 degrees, about 170 degrees, about 175 degrees, or about 180, or about 185 degrees, or about 190 degrees, or about 195 degrees, or about 200 degrees with respect to one another.

The term "vessel" refers to any type of floating structure including but not limited to tankers, boats, ships, FSOs, FPSOs, FLNGs, FSRUs, and the like.

Figure 2:
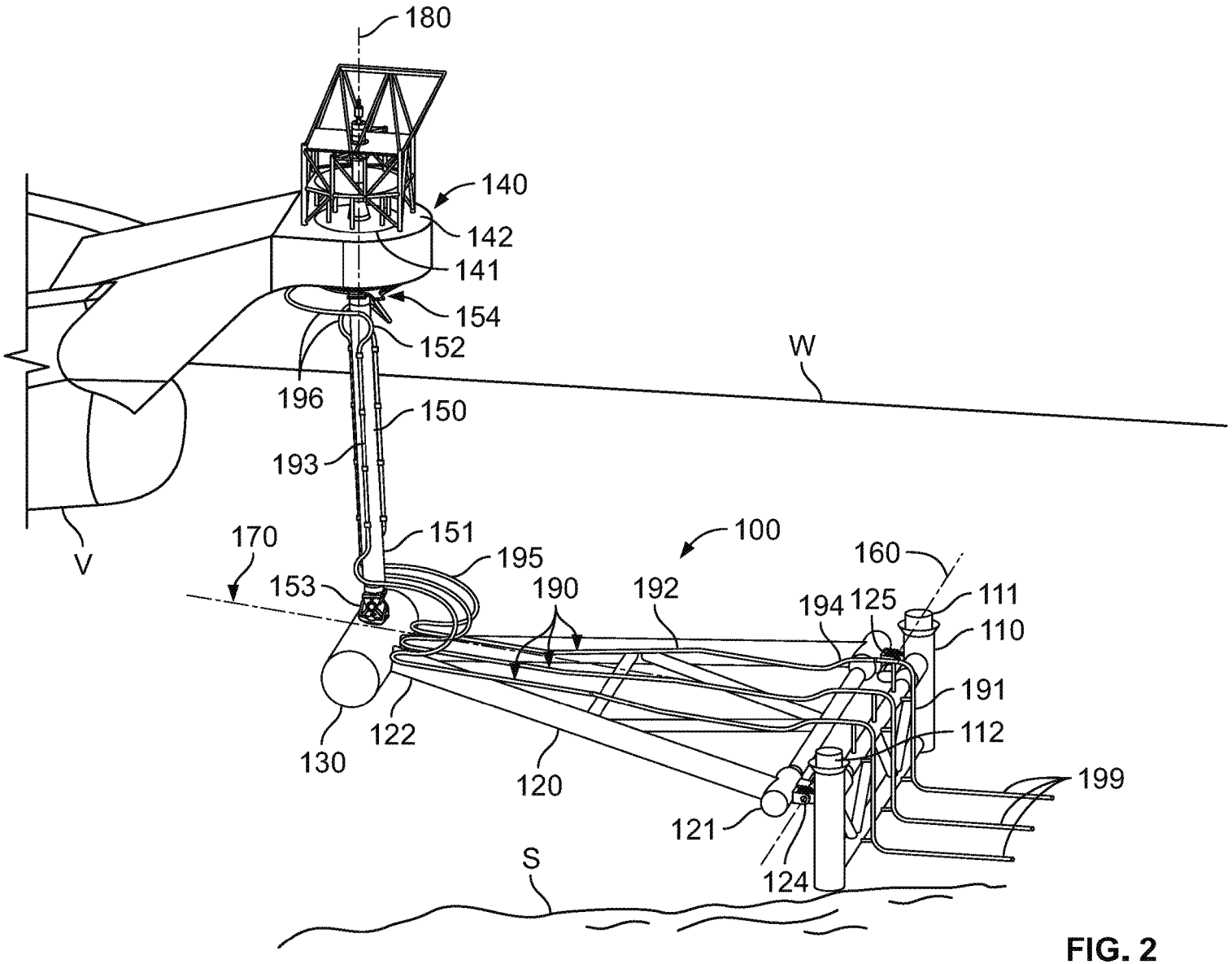

FIGS. 1 and 2 depict isometric views of an illustrative mooring system 100 for mooring a vessel V floating on a surface of a body of water W, according to one more embodiments. In some embodiments, the mooring system 100 can include a base structure 110 configured to be fixed to a seabed S. In some embodiments, the base structure 110 can be secured to the seabed by one or more driven piles (two are shown, 111, 112). In other embodiments, the base structure 110 can be secured to the seabed S via one or more suction piles, one or more gravity anchors, one or more driven piles 111, 112, or a combination thereof. The particular apparatus used to secure the base structure 110 to the seabed S can be based, at least in part, on the seabed conditions at the site and the anticipated loads that will be directed to the base structure 110. In some embodiments, the base structure 110 can be a fabricated structure, e.g., a steel structure, a concrete structure, or a combination thereof. In some embodiments, the driven piles 111, 112 can be rolled tubular members, pipes, or other similar pile material(s).

In some embodiments, the mooring system 100 can include a yoke 120 that can include a first end 121 and a second end 122. In some embodiments, the first end 121 of the yoke can be configured to connect to the base structure 110 such that the yoke 120 can pivot about an axis 160 of the base structure 110. In some embodiments, the axis 160 of the base structure 110 can be substantially parallel with the seabed S. In other embodiments, the axis 160 of the base structure 110 can be substantially parallel with a surface of the body of water W during a calm state. In some embodiments the yoke 120 can be a fabricated structure, e.g., a steel structure. In some embodiments, the yoke 120 can have a longitudinal axis 170 that can extend from a midpoint at the first end 121 of the yoke 120 to a midpoint at the second end 122 of the yoke 120, as shown in FIG. 2. In some embodiments, the longitudinal axis 170 can be a longitudinal line of symmetry of the yoke. In some embodiments, the longitudinal axis 170 can be substantially orthogonal or substantially perpendicular to the axis 160 of the base structure 110. In some embodiments, the axis 160 of the base structure 110 can be substantially orthogonal or substantially perpendicular to the longitudinal axis 170 of the yoke 120 and substantially parallel with the seabed S and/or substantially parallel with the surface of the body of water W during a calm state.

In some embodiments, the connection between the yoke 120 and the base structure 110 can include at least one yoke hinge (two are shown, 124, 125). The yoke hinges 124, 125 can permit the yoke 120 to pivot with respect to the base structure 110 about the axis 160 of the base structure 110.

In some embodiments, the mooring system 100 can include a weight 130 that can be connected to the yoke 120 toward the second end 122 of the yoke 120. In some embodiments, the weight 130 can have a specific gravity greater than the specific gravity of the body of water. In some embodiments, the weight 130 can be a ballast tank. The ballast tank can be configured to contain a ballast material. The ballast material can be any suitable solid material or liquid material or combination thereof. Examples of ballast material can be or can include, but are not limited to, concrete, sand, aggregate, iron ore, magnetite, rocks, drilling mud, water, sea water, any other material or combination thereof. In some embodiments the weight 130 can be a fabricated structure, e.g., a steel structure. In some embodiments, not shown, the weight 130 can include a solid mass, or a structure, such as a frame that can receive one or more weights, for example metallic and/or concrete blocks.

In some embodiments, the mooring system 100 can include a turntable 140 that can have a fixed part 141 and a rotating part 142. The rotating part 142 of the turntable 140 can be disposed on the vessel V. The turntable 140 can provide for unlimited rotation of the vessel V relative to the fixed part 141 of the turntable 140 about a central axis 180. The turntable 140 can be configured to transfer loads from the fixed part 141 to the rotating part 142 of the turntable 140 or from the rotating part 142 to the fixed part 141 of the turntable 140 while the vessel V rotates about the central axis 180. In some embodiments the turntable 140 can be a fabricated structure, e.g., a steel structure.

In some embodiments, the mooring system 100 can include a link arm 150 that can include a first end 151 configured to be connected to the second end of the yoke 120 and/or the weight 130 and a second end 152 that can be configured to be connected to the fixed part 141 of the turntable 140. In some embodiments, the link arm 150 can be configured as an elongated rigid or semi rigid structure that can include a dual axis or universal joint 153, 154 (see FIG. 3) disposed at each of the first end 151 and the second end 152 of the link arm 150, respectively. In other embodiments, the link arm 150 can be configured as a flexible tension member, for example a tether, a chain, a rope, a wire rope, or a combination thereof. In some embodiments, the dual axis joints 153, 154 can provide for rotation about two axes of rotation that are substantially orthogonal to one another. In this way, the link arm 150 can rotate or pivot relative to the fixed part 141 of the turntable 140 about two axes of rotation and similarly the link arm 150 can rotate or pivot relative to the yoke 120 and/or the weight 130 about two axes of rotation.

In some embodiments, the mooring system 100 can include at least one conduit 190, three are shown. In some embodiments, the conduit(s) 190 can be a fluid conduit, an electrical conduit, an optical fiber conduit, or a combination thereof. It should be understood that any of the conduits described herein can be a fluid conduit, an electrical conduit, an optical conduit, or a combination thereof. In some embodiments, the conduit(s) 190 can be fluid conduits configured to convey a fluid from a corresponding pipeline 199 disposed on the seabed S to the fixed part 141 of the turntable 140 and/or to convey a fluid from the fixed part 141 of the turntable 140 to the corresponding pipeline 199 disposed on the seabed S. Examples of the conveyed fluids can be or can include, but are not limited to natural gas, oil, water, diesel, gasoline, liquid petroleum gas, liquified natural gas, ammonia, crude oil, or any other fluid. In other embodiments, two or more of the conduits 190 can be configured to convey the fluid to or from a single pipeline 199 disposed on the seabed S. In some embodiments, the conduit(s) 190 can be configured to convey an electrical signal, electrical power, optical signals, or a combination thereof. In some embodiments, the conduit(s) 190 can be configured to convey a combination of electrical, fluid, and/or optical signals.

In some embodiments, the fluid conduit(s) 190 can include one or more rigid pipe segments 191, 192, 193 mounted on, affixed to, or otherwise supported on or by the base structure 110, the yoke 120, the weight 130, and/or the link arm 150. In some embodiments, the fluid conduit(s) 190 can include one or more flexible pipe or hose segments 194, 195, 196 that bridge between the base structure 110 and the yoke 120, and/or between the yoke 120 and/or weight 130 and the link arm 150, and/or between the link arm 150 and the fixed part 141 of the turntable 140 such that the fluid can be conveyed from the fixed part 141 of the turntable 140 to the pipeline 199 disposed on the seabed S or vice versa, while the yoke 120 pivots relative to the base structure 110 and/or while the link arm 150 pivots relative to the yoke 120 and/or weight 130 and/or the link arm 150 pivots relative to the fixed part 141 of the turntable 140.

Figure 3:
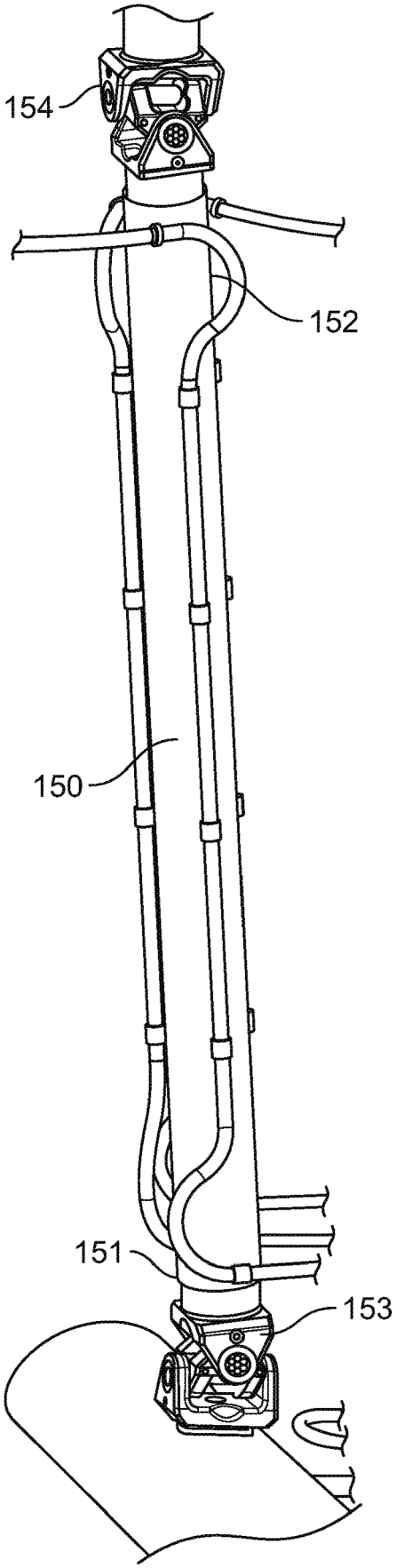
FIG. 3 depicts a close-up isometric view of an illustrative link arm depicted in FIGS. 1 and 2 that includes a dual axis joint disposed at each end thereof, according to one or more embodiments described.

FIG. 3 depicts a close-up isometric view of the link arm 150 depicted in FIGS. 1 and 2 that includes the dual axis joints 153, 154 disposed at each end of the link arm 150, according to one or more embodiments. In other embodiments, not shown, the link arm 150 can be configured as an elongated member that can include ball and socket joints or flexible joints that can include a plurality of steel and rubber spherical layers laminated together to provide rotational articulation about two non-parallel axes disposed at each end thereof, or as chains or a plurality of parallel chains with a padeye or tri-plate disposed at each end thereof. An illustrative commercially available flex joint can include the FLEXJOINT® available from Oil States Industries.

In some embodiments, the mooring system 100 can be configured such that yoke 120 and the weight 130 are located below the surface of the body of water as shown in FIGS. 1 and 2. In other embodiments, not shown, the mooring system 100 can be configured such that at least a portion of the yoke 120, and/or at least a portion of the weight 130, and/or at least a portion of the base structure 110 can be located above the surface of the body of water.

Figure 4:
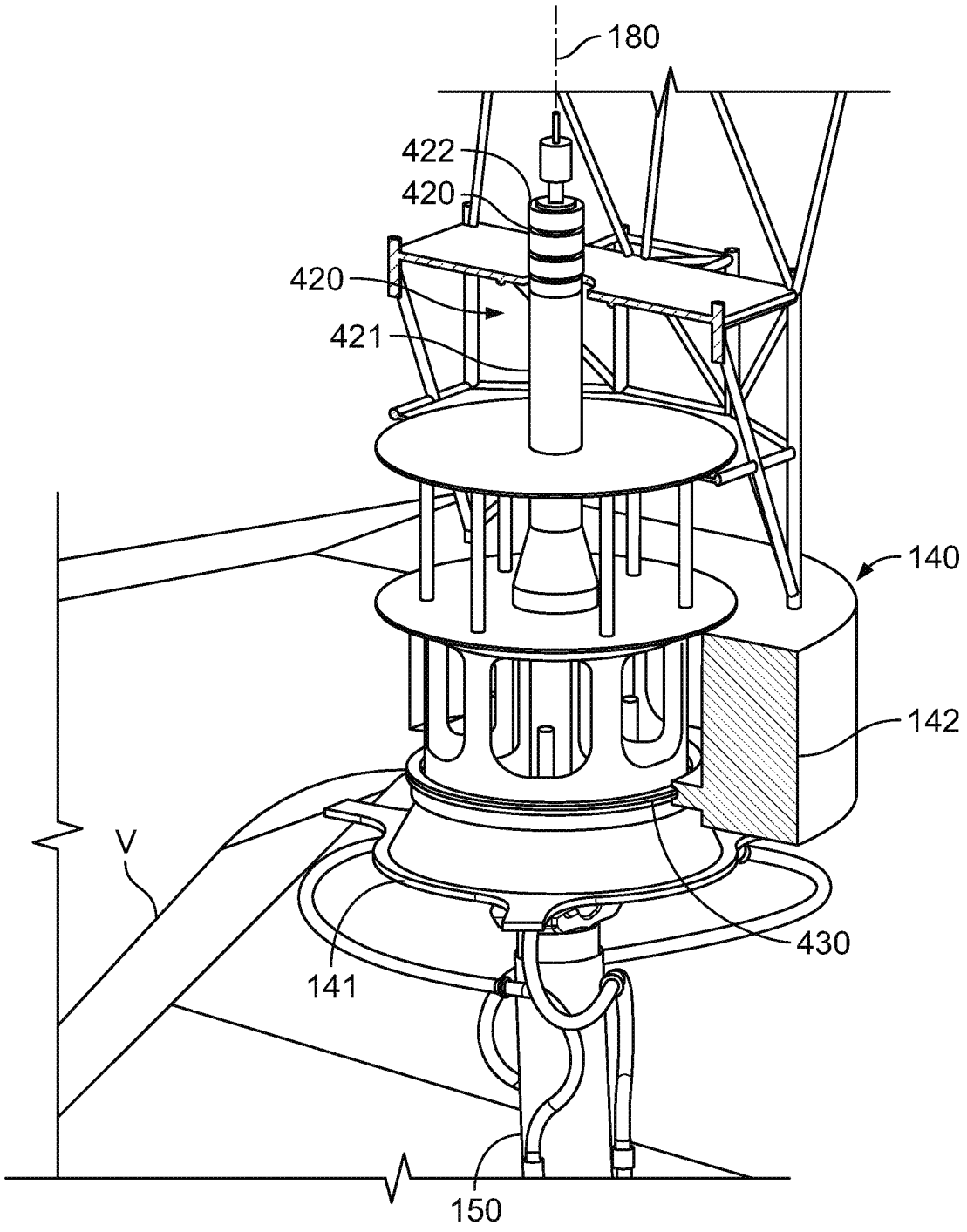
FIG. 4 depicts a partial cutaway elevation view of an illustrative turntable and an illustrative swivel disposed on a vessel, according to one or more embodiments described.

FIG. 4 depicts a partial cutaway elevation view of an illustrative turntable 140 and an illustrative swivel 420, according to one or more embodiments. As described above, the turntable 140 can include the fixed part 141 and the rotating part 142. The turntable 140 can transfer loads from the vessel V to the link arm 150 and from the link arm 150 to the vessel V while allowing the vessel V to rotate about the central axis 180. The turntable 140 can include a bearing 430 that can connect the fixed part 141 of the turntable 140 to the rotating part 142 of the turntable 140. The bearing 430 can be any suitable mechanical bearing, e.g., a 3-row roller bearing, a wheel and rail type bearing, or a bushing type bearing system. The fixed part 421 of the swivel 420 can be disposed on or connected to the fixed part 141 of the turntable 140 and the rotating part 422 of the swivel 420 can be disposed on or connected to the rotating part 142 of the turntable 140. The swivel 420 can be configured to maintain communication between a conduit disposed on the fixed part 141 of the turntable 140 and a conduit disposed on the rotating part 142 of the turntable 140 while the vessel V rotates about the central axis 180. In some embodiments the swivel 420 can be configured as a fluid swivel. In other embodiments the swivel 420 can be configured as an electrical swivel or electrical slip ring, or as a fiber optic swivel. In other embodiments, the swivel 420 can be configured as a combined fluid and/or electrical swivel or electrical slip ring and/or fiber optic swivel. The fixed part 141 and the rotating part 142 of the swivel 420 can be configured to maintain fluid communication, electrical communication, and/or optical communication therebetween, depending on the particular configuration of the swivel 420.

Figure 5:
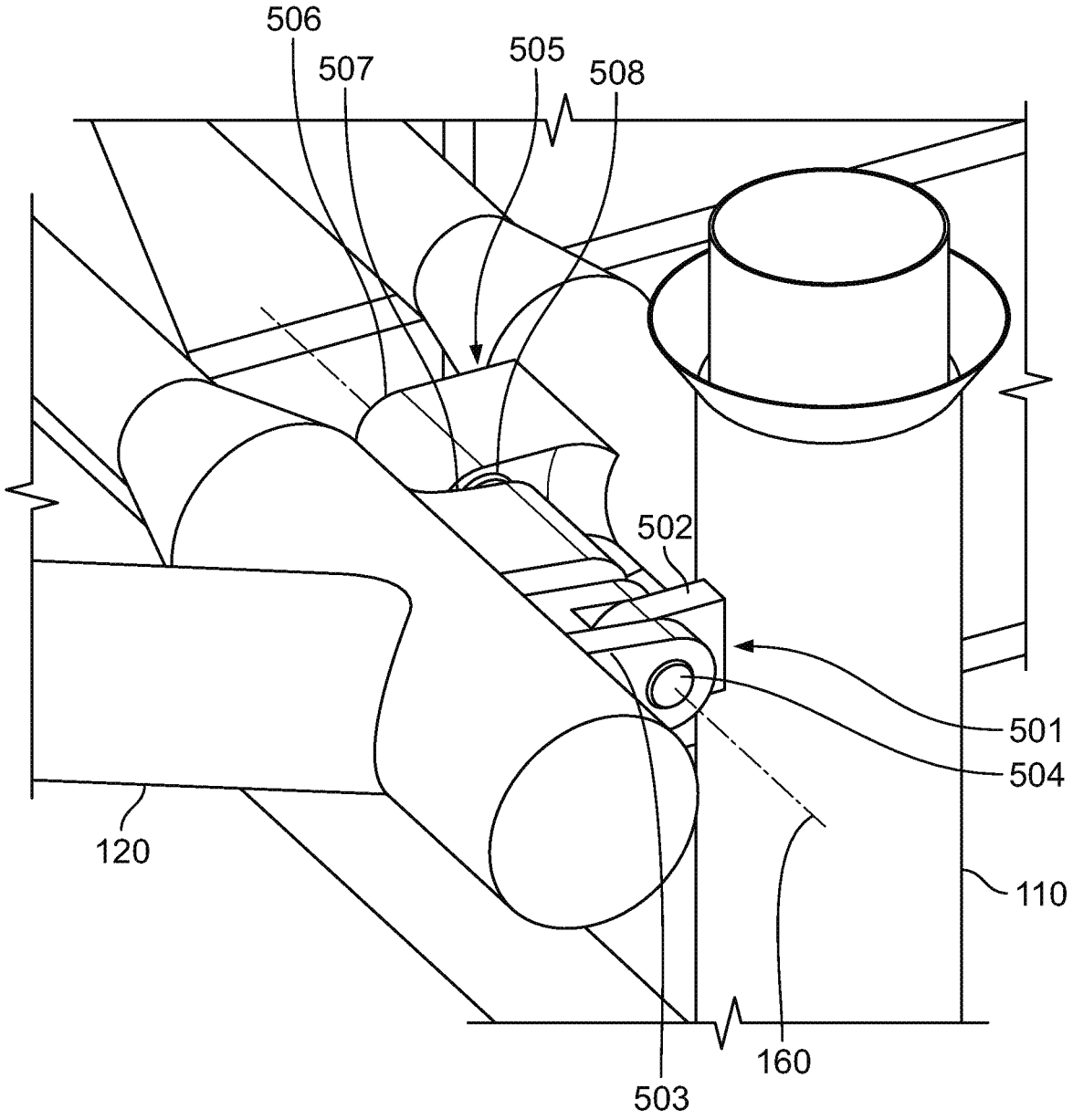
FIG. 5 depicts an isometric view of an illustrative yoke hinge and thrust bearing connected to a base structure, according to one or more embodiments described.

FIG. 5 depicts an isometric view of an illustrative yoke hinge 501 and thrust bearing 505, according to one or more embodiments. In some embodiments, the mooring system 100 can include a plurality of yoke hinges 501 and a plurality of thrust bearings 505. The yoke hinge 501 can be configured to allow the yoke 120 to pivot about the axis 160 of the base structure 110. The yoke hinge 501 can include a first part 502 disposed on the base structure 510, a second part 503 disposed on the yoke structure 520, and a pin 504 that can connect the first part 502 to the second part 503. The first part 502 and the second part 503 of the yoke hinge 501 can each define a cylindrical bore having a central axis. The central axis of the cylindrical bores defined by the first part 502 and the second part 503 can be axially aligned such that the pin 504 can be disposed through the axially aligned bores of the first part 502 and the second part 503. A central axis of the pin 504 can be colinear with the central axis of the cylindrical bores defined by the first part 502 and the second part 503, and the axis 160 of the base structure 110. The yoke hinge 501 can be manufactured from steel. In some embodiments, the yoke hinge 501 can be a fabricated structure, a forged structure, a milled structure, or a cast structure.

The thrust bearing 505 can be configured to transfer a shear load from the yoke 120 to the base structure 110 and/or from the base structure 110 to the yoke 120 in a direction that is substantially parallel to the axis 160 of the base structure 110. In some embodiments, the thrust bearing 505 can have a longitudinal axis that is colinear with the axis 160 of the base structure 110. In some embodiments, the thrust bearing can include a first part 506 disposed on the base structure 510 and a second part 507 disposed on the yoke 120. In some embodiments the thrust bearing 505 can include a bushing 508 disposed between the first part 506 and the second part 507 of the thrust bearing 505. In some embodiments, the first part 506 of the thrust bearing 505, the second part 507 of the thrust bearing 505, and the bushing 508 can include a surface, e.g., a flat surface, that can be configured to matingly engage with one another to transfer a shear load from the yoke 120 to the base structure 110 and/or from the base structure 110 to the yoke 120. The thrust bearing 505 can be manufactured from steel. For example, the thrust bearing 505 can be a fabricated structure, a forged structure, a milled structure, or a cast structure. The bushing 508 can be manufactured from brass, a polymer, a fiber reinforced composite material, or any other suitable material or combination of materials.

Figure 6:
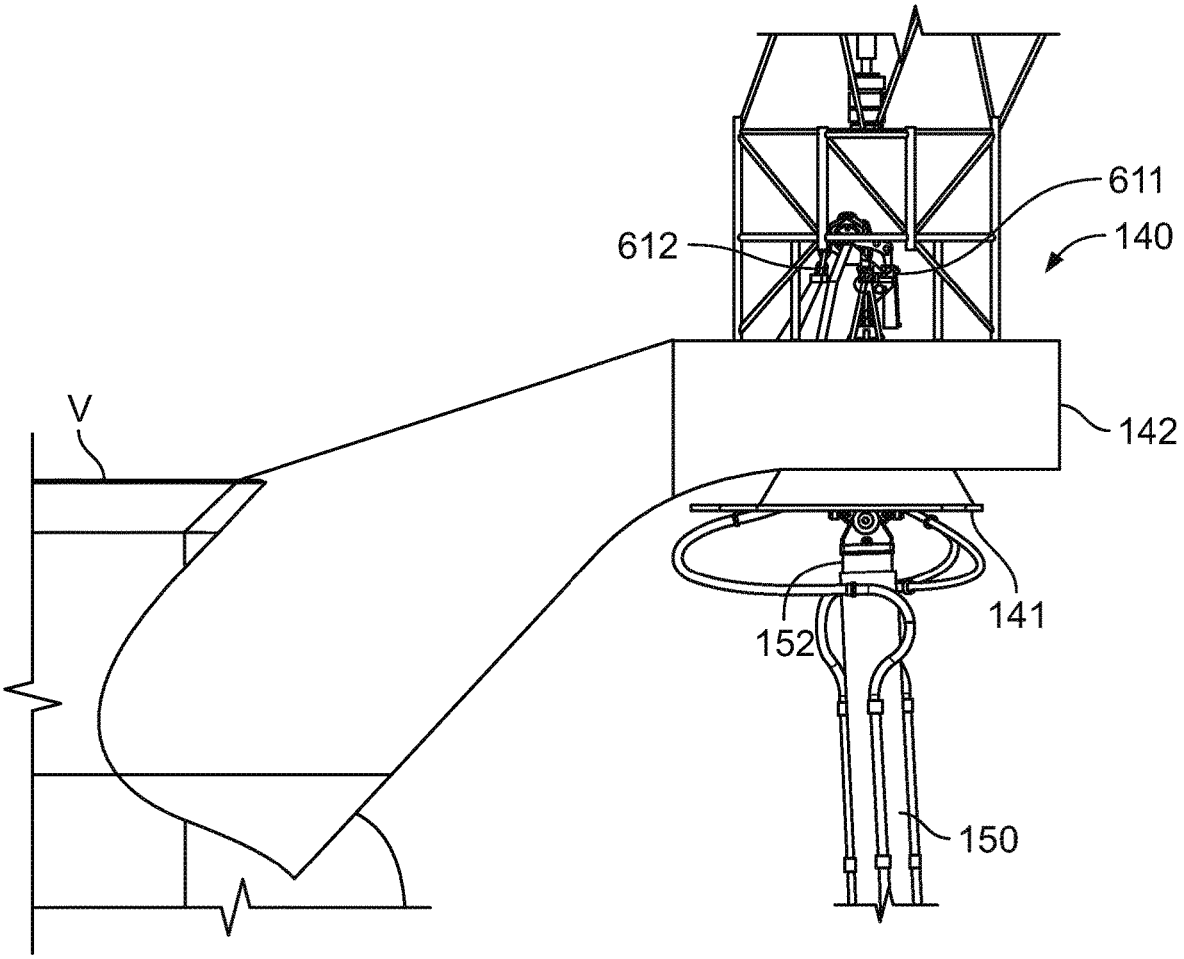
FIG. 6 depicts a side elevation view of an illustrative turntable disposed on a vessel that includes a link arm connected thereto and an illustrative lifting device, according to one or more embodiments described.
Figure 7:
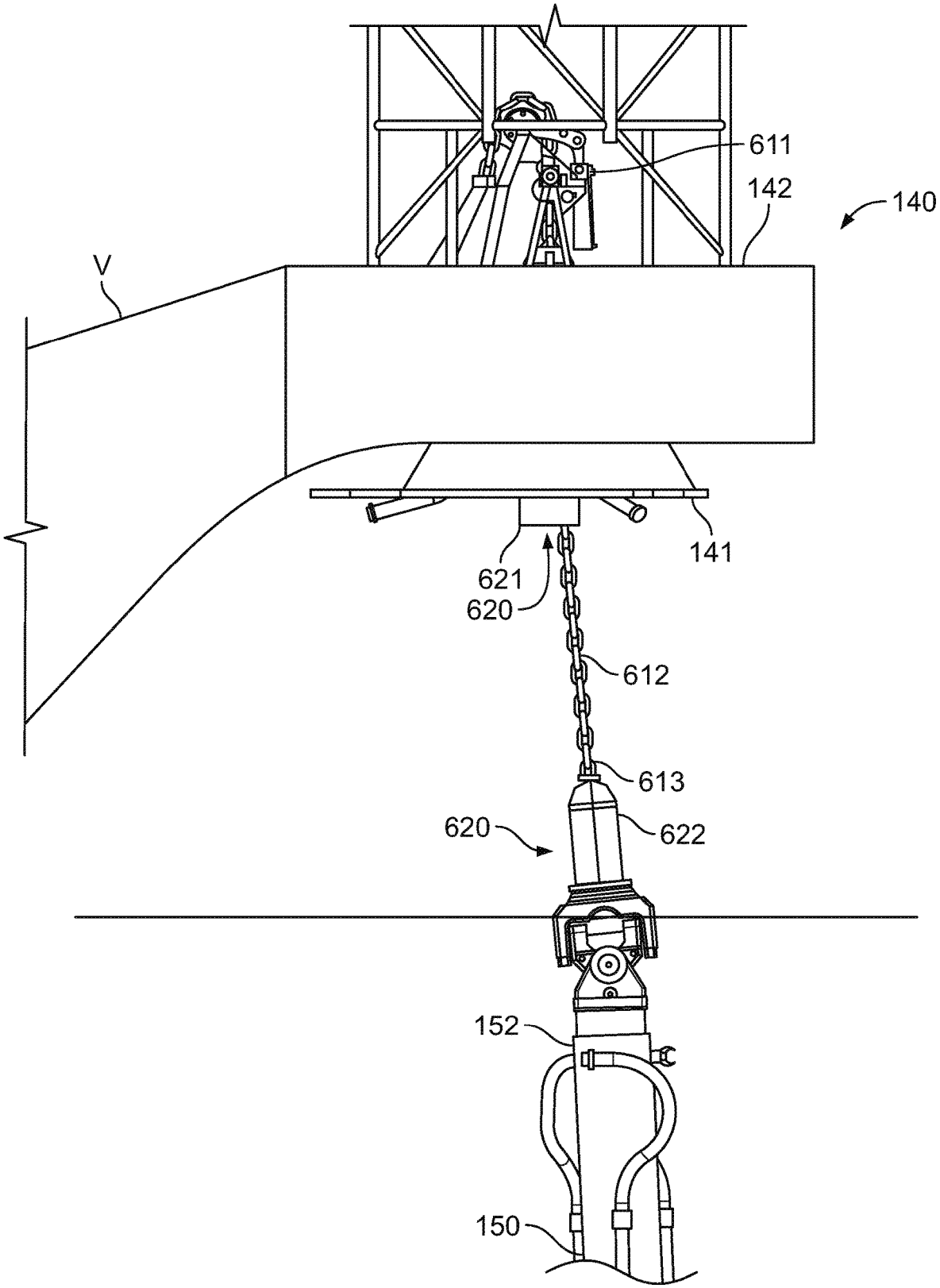
FIG. 7 depicts a side elevation view of an illustrative turntable disposed on a vessel, an illustrative releasable connector in a released configuration, and an illustrative lifting device, according to one or more embodiments described.

FIG. 6 depicts a side elevation view of the illustrative turntable 140 disposed on the vessel V that includes the link arm 150 connected thereto, according to one or more embodiments. FIG. 7 depicts a side elevation view of the illustrative turntable 140 disposed on the vessel V, a lifting device 611, and a lifting line 612 according to one or more embodiments. Referring to FIGS. 6 and 7, in some embodiments, the lifting device 611 can be disposed on the vessel V near or above the fixed part 141 of the turntable 140. The lifting device 611 can be or can include, but is not limited to, a chain jack, a strand jack, a linear winch, a rotary winch, other similar device(s), or any combination of such devices. The lifting device 611 can be electrically driven, hydraulically driven, pneumatically driven, diesel driven, or a combination thereof.

A releasable connector 620 can be used to connect the second end 152 of the link arm 150 to the fixed part 141 of the turntable 140. The releasable connector 620 can include a first component 622 disposed on the second end 152 of the link arm 150 and a second component 621 disposed on the fixed part 641 of the turntable 640. In some embodiments, the first component 622 of the connector 620 can be configured as a stinger and can be connected to the second end 152 of the link arm 150. The second component 621 of the connector 620 can include a sleeve assembly connected to or mounted on the fixed part 141 of the turntable 140. In some embodiments, the releasable connector 620 can include a latching mechanism that can be moved from an unlocked position to a locked position to secure the first component 622 within the second component 621. In some embodiments, the releasable connector 620 that can include the first component 622 and the second component 621 can include the releasable connector disclosed in U.S. Patent Application Nos. 63/255,749 and Ser. No. 17/966,184.

The lifting line 612 can include a first end 613 configured to be connected to the first component 622 of the connector 620 (as shown in FIG. 7) or the second end 152 of the link arm 150 (not shown). The mooring system 100 can also include an optional retrieval line, not shown, that can be connected to a second end (not shown) of the lifting line 612. The retrieval line can be configured such that at least a portion of the retrieval line can float on the surface of the body of water to facilitate retrieval of the lifting line. In some embodiments, a buoy can be disposed at a second end of the retrieval line to maintain the second end of the retrieval line on the surface of the body of water. In such embodiment, the retrieval line can be retrieved from the surface of the body of water and routed to the lifting device 611. The lifting device 611 be used to haul in the lifting line until the second end of the lifting line 612 is adjacent or proximate to the lifting device 611. The lifting line 612 can then be engaged with the lifting device 611 and the lifting device 611 can be used to lift the link arm 150, the weight 130, and the yoke 120 until the first component 622 of the releasable connector 620 can be connected to the second component 621 of the releasable connector 620 for connection of the mooring system 100 to the vessel V.

The lifting device 611 can be configured to lift the link arm 150 along with the yoke 120 and the weight 130 from a position where the yoke 120 and the weight 130 are resting on the seabed or an optional landing structure, e.g., a mud mat, located on the seabed to a position at which the yoke 120, the weight 130, and the link arm 150 can be suspended from the vessel V. The lifting device 611 can also be configured to lower the link arm 150 along with the yoke 120 and the weight 130 from the suspended position to a position where the yoke 120, the weight 130, and the link arm 150, are resting on the seabed or resting on the optional landing structure, not shown.

In some embodiments the lifting device 611 can be configured such that a speed at which the lifting device 611 operates to haul in the lifting line 612 can be tuned, adjusted, or otherwise correlated to account for a motion of the vessel that can be caused by vessel heave, wind, waves, swell, and/or current present at a given mooring location. Said another way, the lifting device 611 can be configured to lift and lower the link arm 150, the weight 130, and the yoke 120 at a speed that is at least partially dependent on a motion of the vessel V. In some embodiments, the lifting device 610 can be configured such that a speed at which the lifting device 610 operates to haul in the lifting line 612 is not tuned, adjusted, or otherwise correlated to account for a motion of the vessel V. Said another way, the lifting device 611 can be configured to lift and lower the link arm 150, the weight 130 and the yoke 120 at a speed that is independent from a motion of the vessel V.

Figure 8:
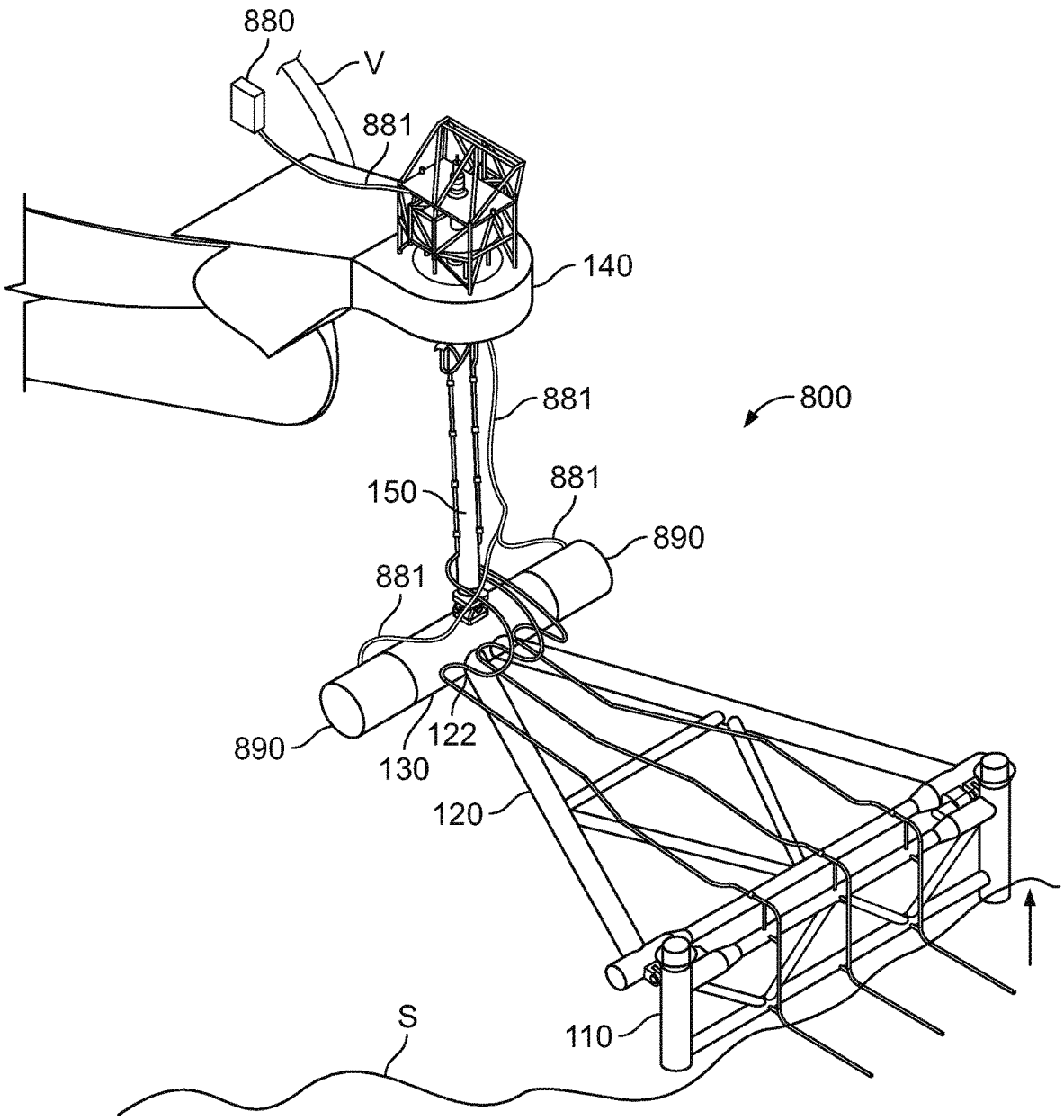
FIG. 8 depicts an isometric view of an illustrative mooring system that includes a buoyancy module disposed on a weight, according to one or more embodiments described.

FIG. 8 depicts an isometric view of an illustrative mooring system 800 that includes at least one buoyancy module 890, two are shown, disposed on the weight 130, according to one or more embodiments. In some embodiments, the mooring system 800 can be configured such that the base structure 110, the yoke 120, and the weight 130 are submerged. In some embodiments, the mooring system 800 and include at least one buoyancy module 890 that can be disposed toward the second end 122 of the yoke 120 or on or near the weight 130. In some embodiments, the mooring system 800 can include, one, two, three, four, or more buoyancy modules 890, two are shown. The buoyancy module(s) 890 can be configured to add a buoyant force to the yoke 120 and/or the weight 130 that can be 10%, 20%, or 50% to 75%, 80%, or even 100% of the weight of the yoke and/or weight. By adding a buoyant force to the yoke 120 and/or weight 130, the corresponding size and cost of the lifting devices disposed on the vessel V (not shown) and used to raise and lower the yoke 120, the link arm 150, and the weight 130 during a connection operation and/or a disconnection operation from the vessel V can be significantly reduced.

In some embodiments, each buoyancy module 890 can be configured as a soft, flexible bladder, a series of soft, flexible bladders or as a rigid fabricated structure that can be pressure balanced with the seawater pressure at the exterior of the buoyancy module. In some embodiments, the buoyancy module 890 can be open to the sea at a position that is toward the bottom of the buoyancy module 890. The buoyancy module 890 can normally be filled with water such that the weight of the mooring system is a maximum and can be filled with a liquid, a gas, or a combination of a liquid and a gas prior to the disconnection or reconnection of the vessel V from the mooring system 800 such that the weight of the mooring system 800 can be reduced. In this way, the dimensions, size, capacity of the lifting device(s) and the corresponding lifting lines can be reduced.

In some embodiments, the buoyancy module 890 can be in fluid communication with a compressor or pump 880. In some embodiments, the compressor or pump can be a compressed gas source. In some embodiments, the compressor or pump can be a pump configured to convey a liquid. The compressor or pump 880 can be disposed on the vessel V or an auxiliary or second vessel, not shown. In some embodiments, the compressor or pump 880 can be a compressor or a bank of compressed gas cylinders. The compressed gas can be air, nitrogen, natural gas, exhaust gas, or any other gas. The compressor or pump 880 can be in fluid communication with the buoyancy module 890 via a conduit 881. The conduit 881 can be a stand-alone flexible pipe, hose, or other similar type of conduit. The conduit 881 can also be disposed within a control umbilical, not shown that can run from the vessel V to the turntable 140 and through the swivel 420. In other embodiments, the compressor or pump 880 can be a pump configured to convey a liquid into the internal volume of the buoyancy module 890. The liquid can have a density that can be less than the water the mooring system 800 is disposed in. In some embodiments, the liquid can be a light hydrocarbon liquid. In still other embodiments, the buoyancy module 890 can be in fluid communication with a compressed gas source and a liquid source.

In some embodiments, the amount of gas disposed inside of the buoyancy module 890 can be selected such that the yoke 120 and the weight 130 are stable if/when resting on the seabed S during a severe weather period after the vessel V has been disconnected. In some embodiments, the amount of gas disposed inside of the buoyancy tank can be reduced after the weight 130 and/or yoke 120 are set on the seabed S thereby increasing the weight of the weight 130 and yoke 120 after disconnection in order to provide additional stability. In some embodiments a gas can be introduced into the buoyancy module 890 prior to reconnecting the vessel to the mooring system 800. In some embodiments, the gas can be disposed into the buoyancy module 890 one time prior to a severe weather season and the gas can be expelled from the buoyancy module 890 upon the passing or completion of the severe weather season, e.g., prior to a hurricane or typhoon season and after a hurricane or typhoon season.

In some embodiments, the mooring system 800 can include a landing structure, not shown, that can be disposed on the seabed S beneath at least a portion of the yoke 120 and/or weight 130 such that when the mooring system 800 is disconnected, it can be set on the landing structure. The landing structure can be incorporated into any of the embodiments described herein. The landing structure can be configured as a steel frame, or steel or concrete mattresses, a gravel pile, rocks placed on the seabed, or other similar material. The landing structure can provide a hard surface for the yoke 120 and/or weight 130 and/or buoyancy module 890 to land on such that the yoke 120, the weight 130, and/or the buoyancy module 890 does not get stuck or adhere to the seabed S which is possible as some seabeds can often have a soft, muddy consistency.

In some embodiments, the weight 130 and/or yoke 120 can include a jetting system incorporated therewith. The jetting system can be configured to eject a gas, a liquid, or a mixture thereof into the seabed to facilitate raising the weight therefrom should the weight become stuck in the seabed while disconnected from the vessel. The jetting system can include one or more jets or nozzles that can be supplied a gas and/or liquid via one or more compressed gas cylinders, pumps, or the like.

Figure 9:
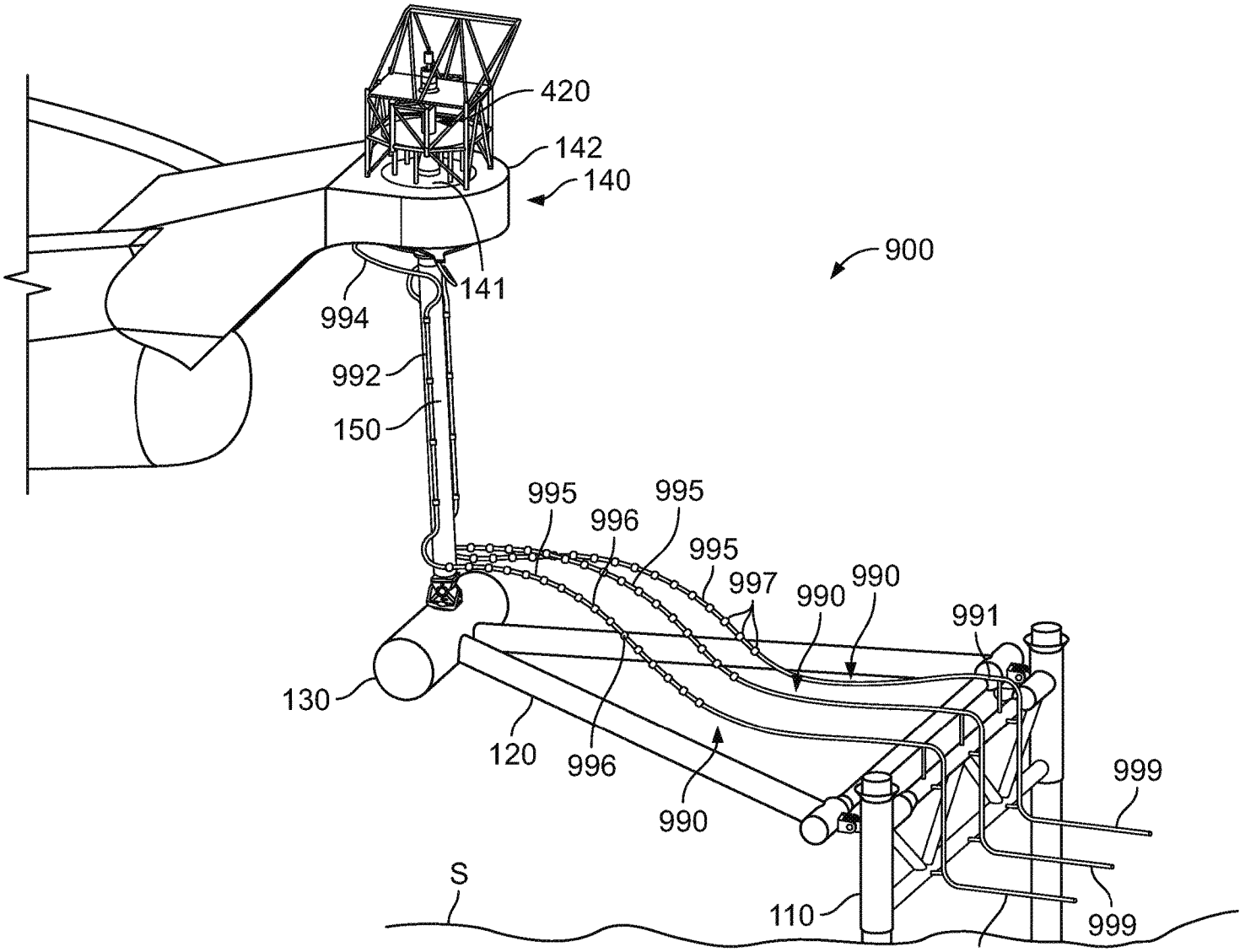
FIG. 9 depicts an isometric view of an illustrative mooring system that includes a conduit assembly disposed on the mooring system, according to one or more embodiments described.

FIG. 9 depicts an isometric view of an illustrative mooring system 900 having at least one conduit 990, three are shown, disposed on the mooring system 900, according to one or more embodiments. In some embodiments, the conduit 990 can include a rigid pipe 991 disposed on the base structure 110 and a rigid pipe 992 disposed on the link arm 150 and can include a flexible pipe or hose 995 spanning from the rigid pipe 991 disposed on the base structure 110 to the rigid pipe 992 disposed on the link arm 150 and a flexible pipe or hose 994 between the rigid pipe 992 disposed on the link arm 150 and a rigid pipe, not visible, disposed on the fixed part 141 of the turntable 140. In some embodiments, the rigid pipe 991 disposed on the base structure 110 can be in fluid communication with pipelines 999 disposed on the seabed S. The flexible pipe or hose 995 spanning from the rigid pipe 991 disposed on the base structure 110 can be configured to have sufficient slack and/or compliance to maintain fluid communication between the rigid pipe 991 on the base structure 110 and the rigid pipe 992 on the link arm 150, as the link arm 150 and the yoke 120 pivot relative to one another and/or as the yoke 120 pivots relative to the base structure 110.

In some embodiments, the flexible pipe or hose 995 can include one or more buoyancy modules 996 and/or one or more weight modules 997 distributed along the length of the flexible pipe or hose 995 to configure the flexible pipe or hose 995 to float at a neutral position and in compliant shape such as a lazy wave, steep wave, an inverse catenary shape, or any other suitable compliant shape below the surface of the body of water. The flexible pipe or hose 994 can be configured to provide fluid communication between the rigid pipe 992 on the link arm 150 and the rigid pipe (not visible) disposed on the fixed part 141 of the swivel 420 of the turntable 140. In some embodiments, the flexible pipe or hose 994 can be configured with valves and/or quick connect/disconnect fittings so as to facilitate rapid disconnection of the flexible pipe or hose 994 and the rigid pipe 992 on the link arm 150. The flexible pipe or hose 994 can be configured to have sufficient slack and/or compliance to maintain fluid communication between the rigid pipe 992 on the link arm 150 and the rigid pipe or swivel 121 on the fixed part 141 of the turntable 140, as the link arm 150 pivots relative to the fixed part 141 of the turntable 140.

Figure 10A:
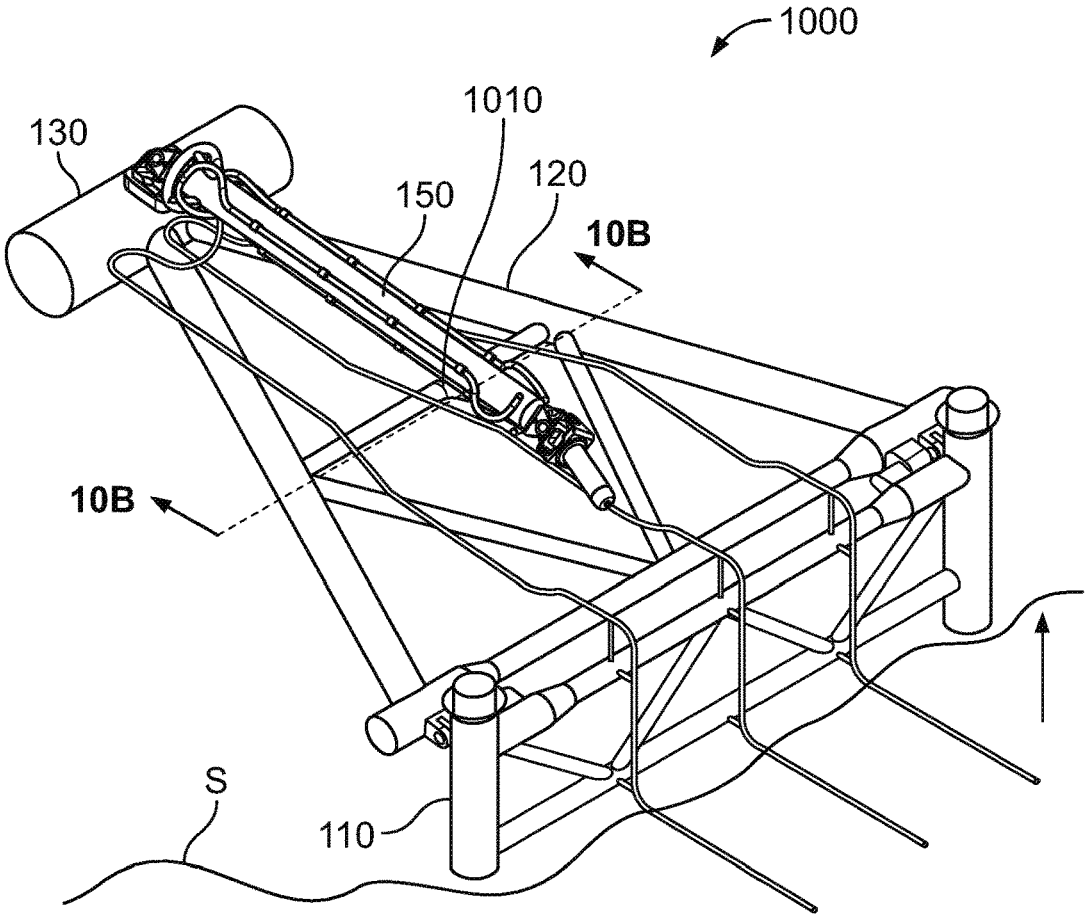
FIG. 10A depicts an isometric view of an illustrative mooring system in a disconnected configuration that includes a yoke and a weight laid down on a seabed and a link arm laid down and supported in a cradle disposed on the yoke, according to one or more embodiments described.
Figure 10B:
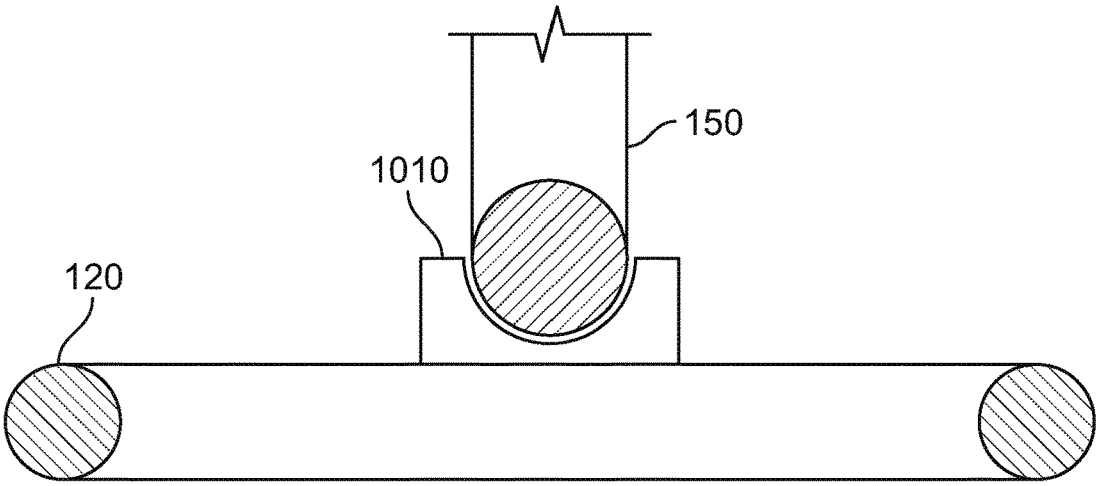
FIG. 10B depicts a partial cross-sectional view of the mooring system depicted in FIG. 10A.
Figure 11:
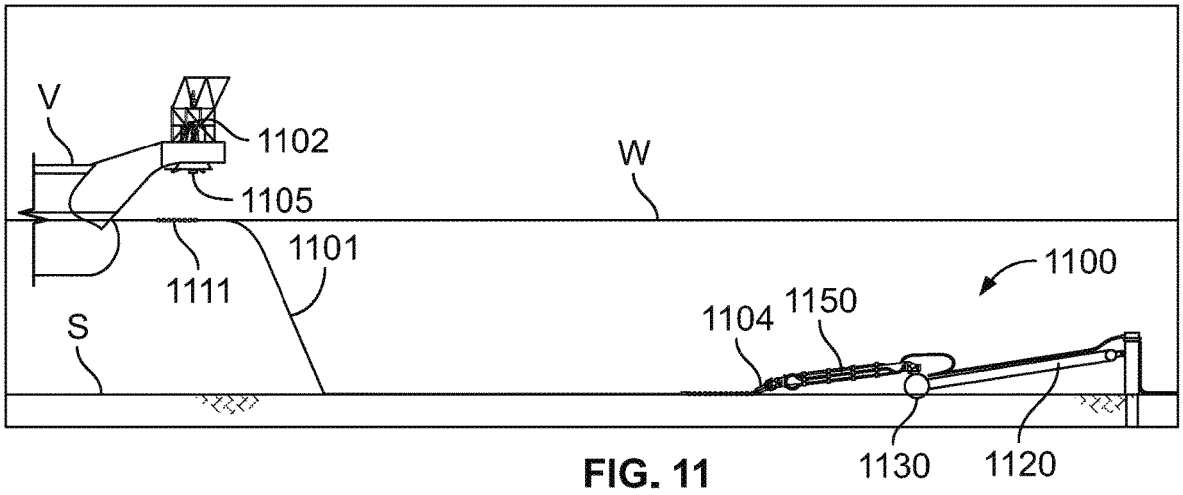
FIGS. 11-16 depict an illustrative process for mooring a vessel floating on a surface of a body of water to an illustrative mooring system, according to one or more embodiments described.
Figure 12:
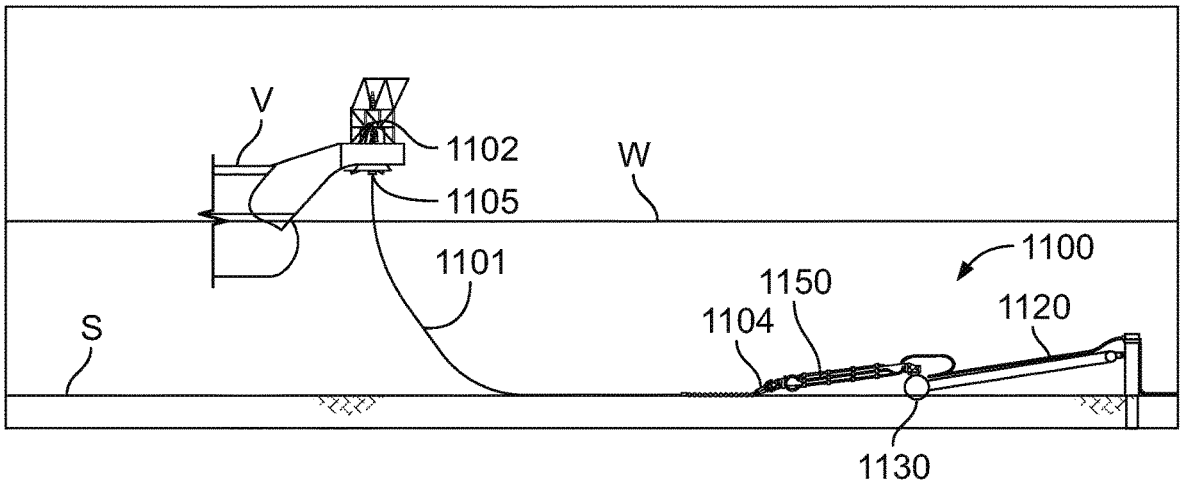
Figure 13:
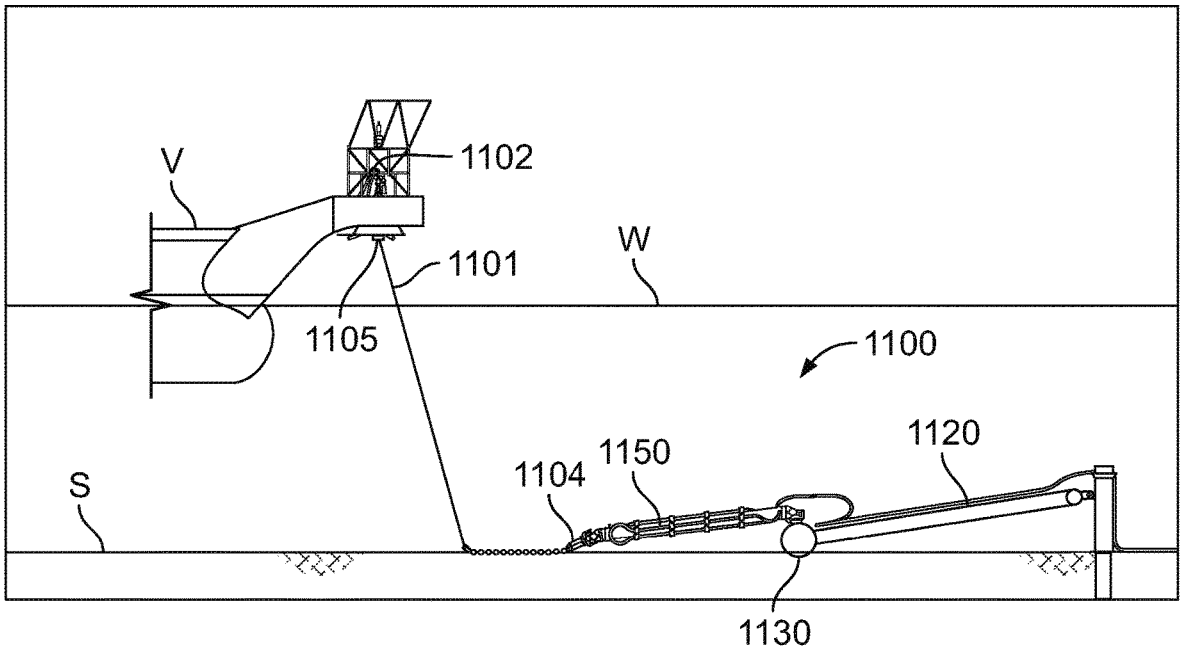
Figure 14:
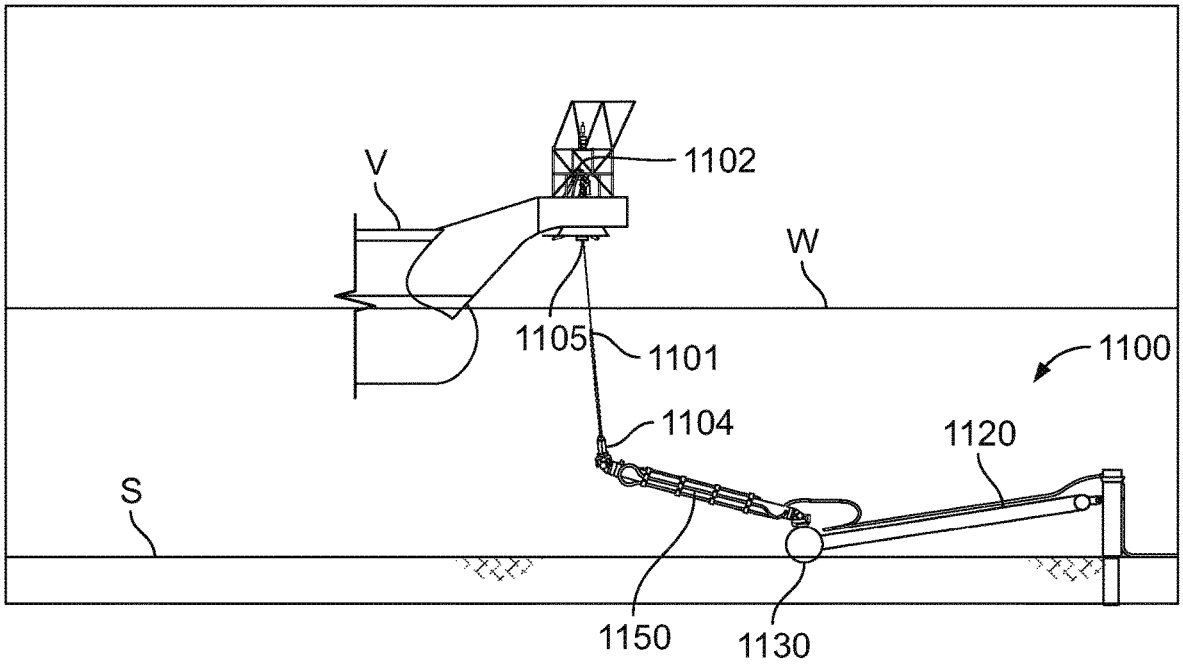
Figure 15:
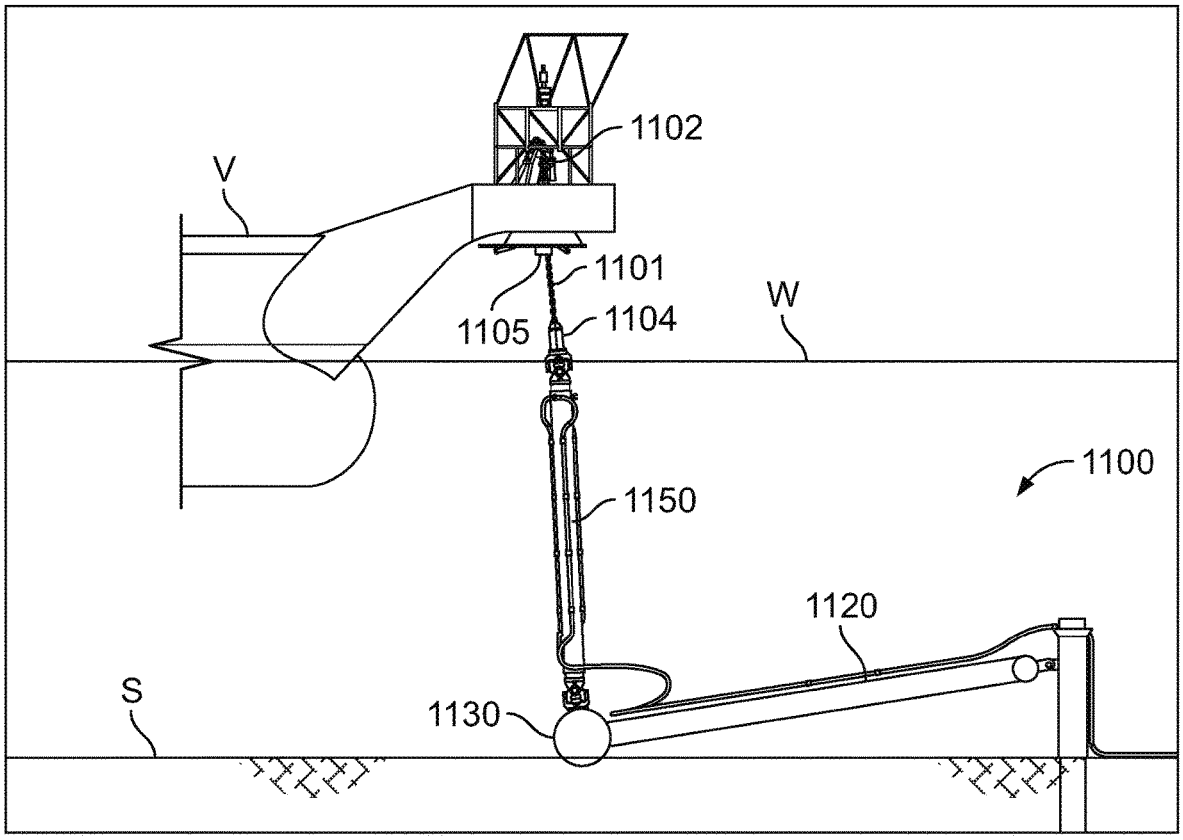
Figure 16:
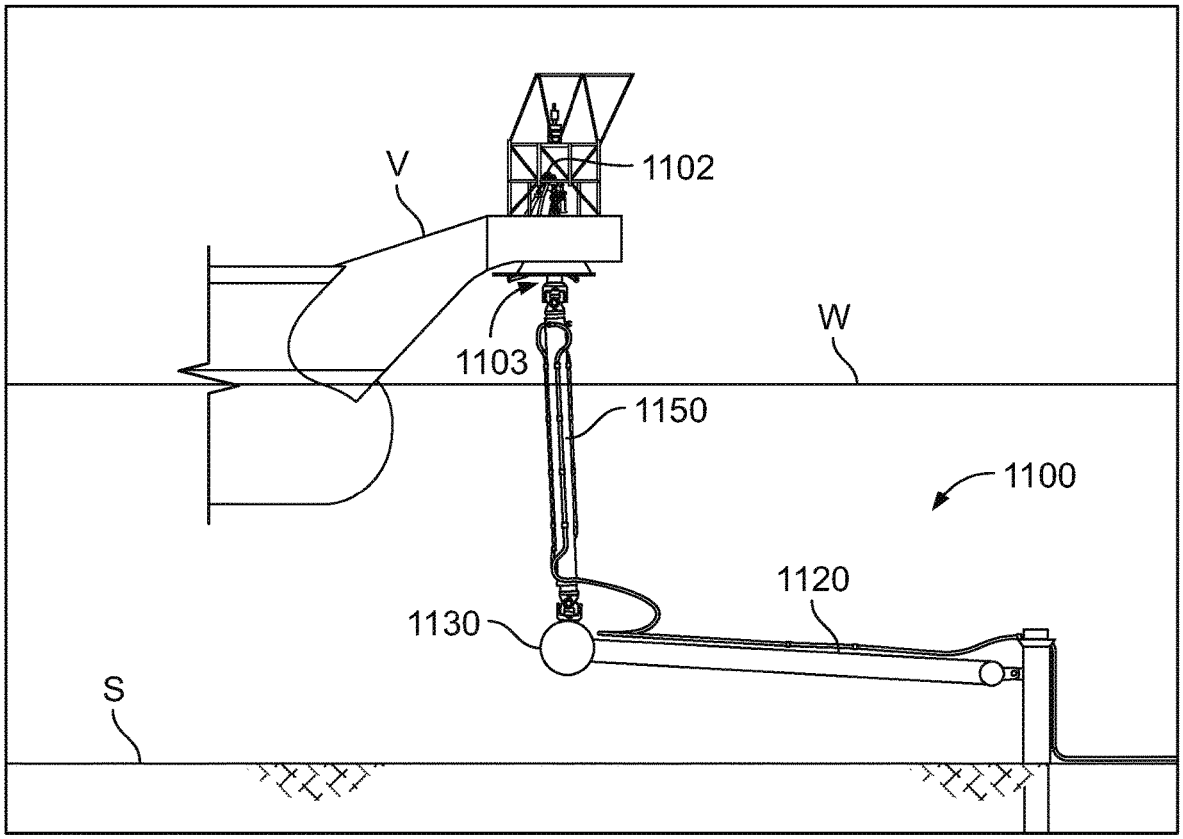
Figure 17:
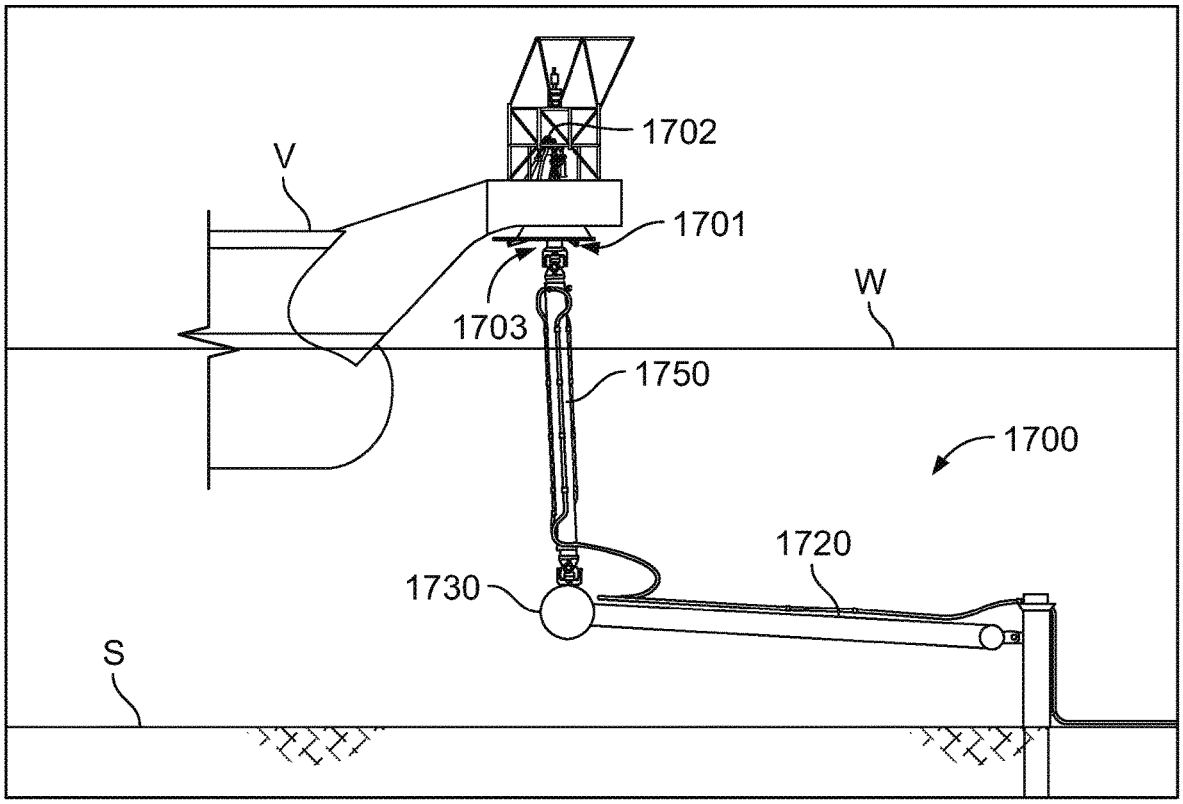
FIGS. 17-22 depict an illustrative process for unmooring a vessel floating on a surface of a body of water from an illustrative mooring system, according to one or more embodiments described.
Figure 18:
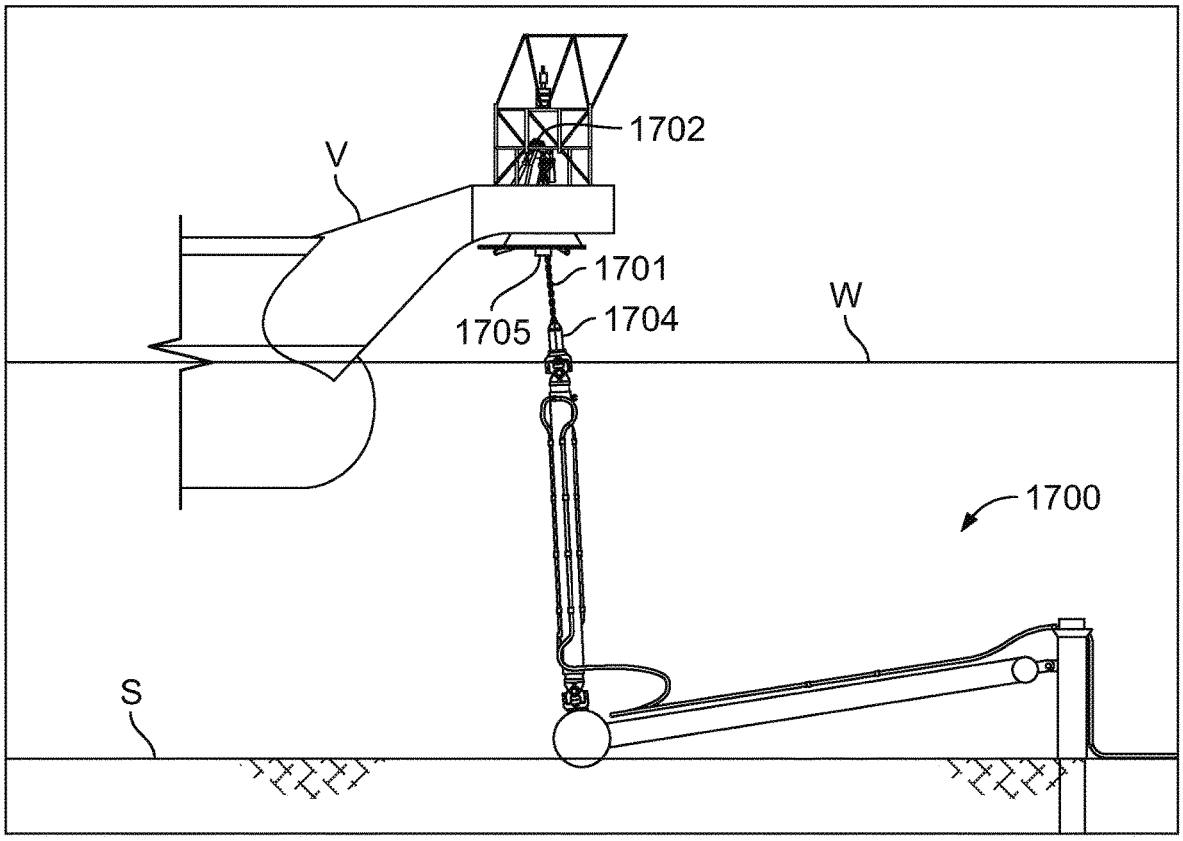
Figure 19:
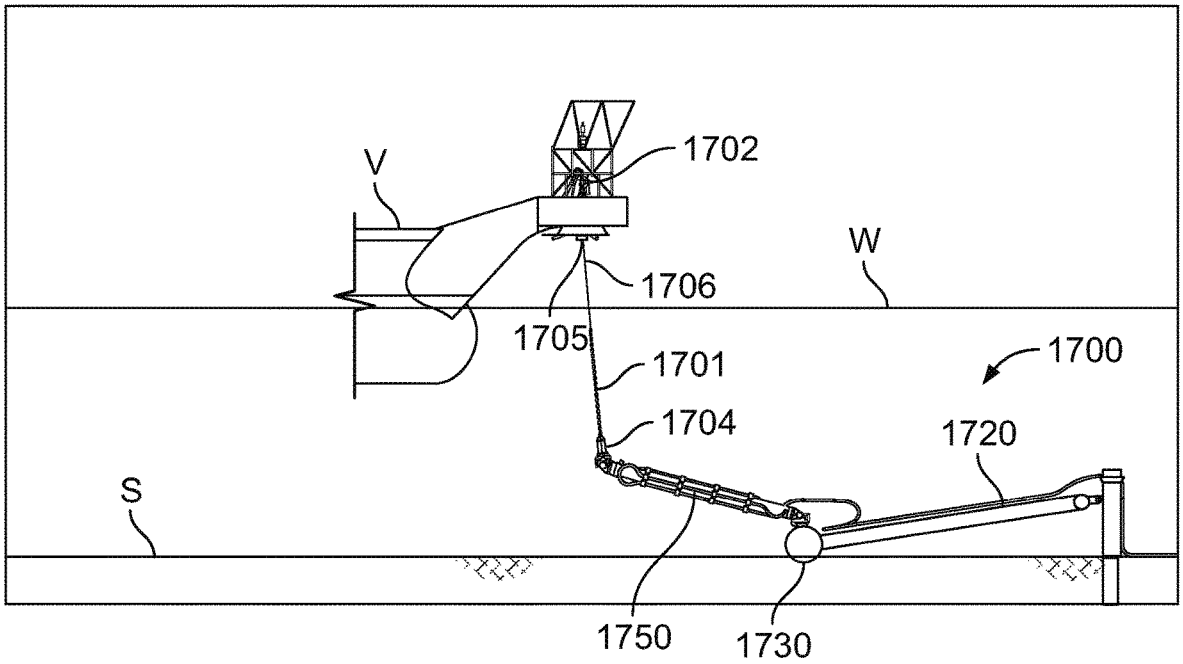
Figure 20:
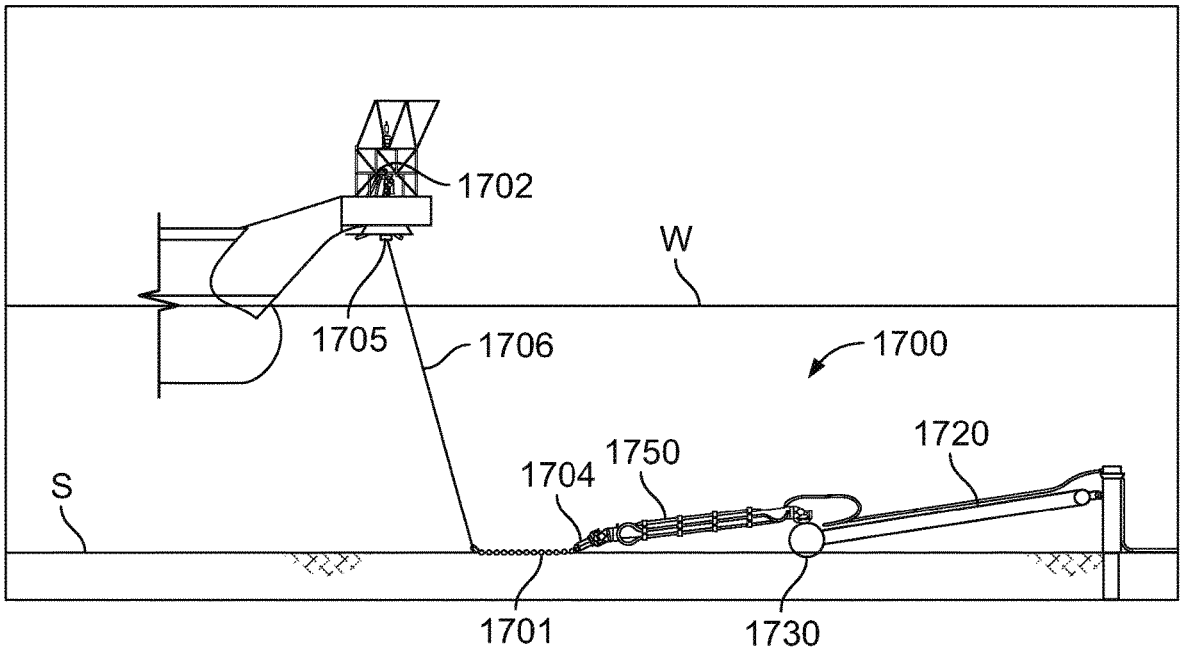
Figure 21:
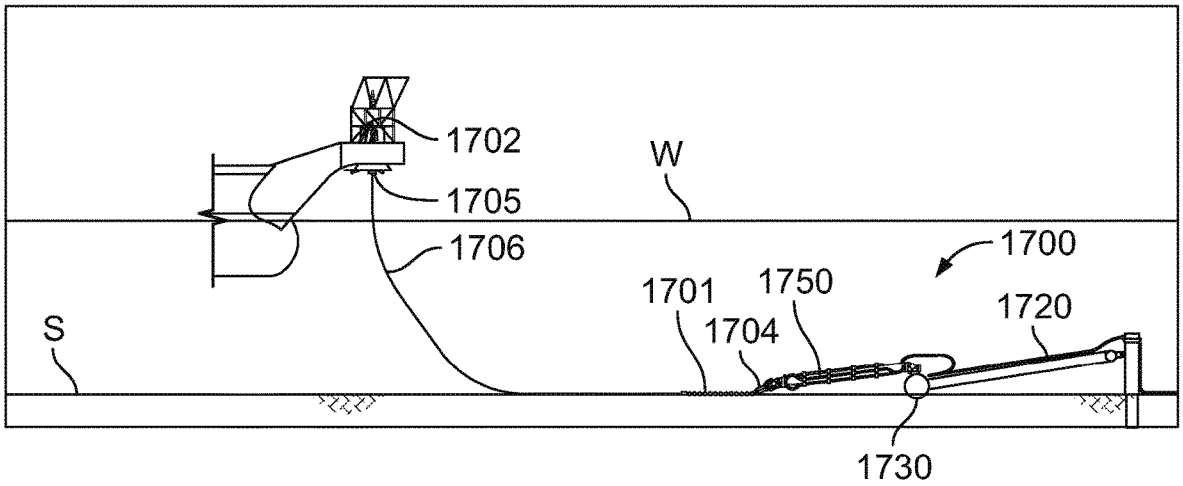
Figure 22:
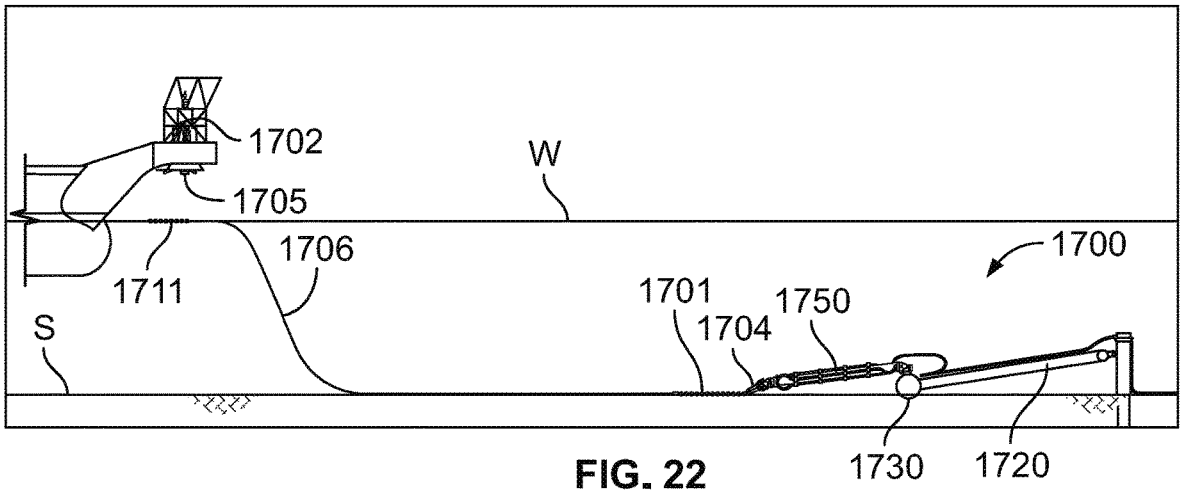

FIG. 10A depicts an isometric view of an illustrative mooring system 1000 in a disconnected configuration with the yoke 120 and weight 130 laid down on the seabed S and the link arm 150 laid down and supported in a cradle 1010 disposed on the yoke 120, according to one or more embodiments. FIG. 10B depicts a partial cross-sectional view of the mooring system 1000 depicted in FIG. 10A. For clarity, the weight 130 and the dual axis joints 153 have been omitted. In some embodiments, the cradle 1010 can be a fabricated steel structure that is disposed on or integral to the yoke 120. The cradle 1010 can include a convex or other recessed shape that can be complementary to and can interface with the exterior shape and/or contour of the link arm 150. In some embodiments, the cradle 1010 can include a strap (not shown) or other tie-down mechanism to secure the link arm 150 to the cradle 1010. In this manner, the link arm 150 can be secured to the cradle 1010 such that it does not become dislodged during a passing storm, for example a hurricane. In some embodiments, the strap can be diver operated. In other embodiments, the strap can be operable by a remotely operated vehicle (ROV). In still other embodiments, it can be sufficient that the weight of the link arm 150 can keep the link arm 150 securely within the cradle 1010 during the passing storm.

FIGS. 11-16 depict an illustrative process for mooring the vessel V floating on the surface of a body of water W to an illustrative mooring system 1100, according to one or more embodiments. In some embodiments the process can include positioning the vessel V near the mooring system 1100 that can be disposed on or connected to a seabed S or optional landing structure. The vessel V can retrieve a retrieval line and/or lifting line 1101 and haul in the retrieval line and/or lifting line 1101 with a lifting device 1102 disposed on the vessel V. In some embodiments, one or more buoyant elements 1111 can be connected to the end of the retrieval line and/or lifting line 1101 such that the end of the retrieval line and/or lifting line 1101 can be maintained at the surface of the body of water W when the vessel V is disconnected from the mooring system 1100.

As the lifting device 1102 hauls in the retrieval and/or lifting line 1101, the vessel V can move toward the mooring system 1100. In some embodiments, the link arm 1150 can be lifted off of the seabed S or optional landing structure prior to the yoke 1120 and the weight 1130 being lifted off of the seabed S. In some embodiments, the vessel V can apply a thrust in a direction away from the mooring system 1100 to avoid or minimize peak loading or dynamic loading on the retrieval and/or lifting line 1101 that can result from lifting the yoke 1120 and weight 1130 off the seabed S or optional landing structure. The vessel V can continue to haul in the retrieval line and/or lifting line 1101 with the lifting device 1102 until a second component 1104 of a releasable connector 1103 (see FIG. 16) is located adjacent to a first component 1105 of the releasable connector 1103 that can be disposed on the vessel V. The first component 1105 of the releasable connector 1103 can be connected to the second component 1104 of the releasable connector 1103 to secure the vessel V to the mooring system 1100.

In some embodiments, prior to lifting the link arm 1150, the weight 1130, and the yoke 1120 off of the seabed S or optional landing structure, one or more buoyancy modules, e.g., the buoyancy module 890 shown in FIG. 8, can be disposed on or otherwise connected to the weight 1130 and/or yoke 1120 and can be filled with a fluid to apply a buoyant force to the yoke 1120 and/or the weight 1130. In some embodiments, a fluid can be introduced into the buoyancy module 890 by connecting the buoyancy module 890 to a compressed gas source, e.g., the gas compressor 880 shown in FIG. 8. In some embodiments, the buoyancy module 890 can be a rigid structure and the gas can displace a liquid disposed inside of the buoyancy module 890 into the body of water. In other embodiments, the buoyancy module 890 can be a flexible bladder, not shown and the gas can fill the buoyancy module.

In some embodiments, when the weight 1130 includes ballast that can be introduced into the body of water, e.g., water or seawater, the weight can be emptied of its ballast to reduce the weight of the yoke 1120 and the weight 1130 and, once the second component 1104 of the releasable connector is connected to the first component 1103 of the releasable connector, ballast, e.g., water or seawater, can be reintroduced into the weight 1130.

In some embodiments, the link arm 1150, rather than laying or resting on the seabed S, can be laid or resting in a cradle, e.g., the cradle 1010 shown in FIG. 10, that can be disposed on the yoke 1120 while the yoke 1120 and/or the weight 1130 can be laying or resting on the seabed S.

FIGS. 17-22 depict an illustrative process for unmooring a vessel V floating on a surface of a body of water W from a mooring system 1700, according to one or more embodiments. The vessel V can be moored to the mooring system 1700 via a releasable connector 1703. A first component 1704 of the releasable connector 1703 can be released or disconnected from a second component 1705 of the releasable connector 1703. The weight 1730 and the yoke 1720 can be lowered to and placed on the seabed S or an optional landing structure with a lifting line 1701 and a lifting device 1702. In some embodiments, the lifting line 1701 can be further lowered using a retrieval line 1706 with the lifting device 1702 such that the link arm 1750 can be laid on the seabed S. In some embodiments, the yoke 1720, the weight 1730, and the link arm 1750 can be lowered to and placed on the seabed S or optional landing structure with the lifting line 1701 and/or the retrieval line 1706 and the lifting device 1702. The lifting line 1701 and/or retrieval line 1706 can then be disconnected from the lifting device 1702 and the vessel V can then be free from the mooring system 1700. The vessel V is then free to maneuver away from the mooring system 1700. In some embodiments, one or more buoyant elements 1711 can be connected to the end of the retrieval line 1706 such that the end of the retrieval line 1706 can be maintained at the surface of the body of water W when the vessel V is disconnected from the mooring system 1100.

In some embodiments, the process can include the step of applying a tension to the lifting line 1701 with the lifting device 1702 disposed on the vessel V to remove at least a portion of a tension load from the releasable connector 1703. In some embodiments, the tension applied can be between 0.1 kilonewtons (kN), 1 kN, 2 kN, 5 kN, 10 kN, 15 kN, 20 kN, or 25 kN to 50 kN, 70 kN, 90 kN, or 100 kN.

In some embodiments, the process can include laying or setting the link arm 1750 into a cradle (for example 1010 shown in FIGS. 10A and 10B) that can be disposed on the yoke 1720 while the yoke 1720 and the weight 1730 can be set on the seabed S.

Figure 23:
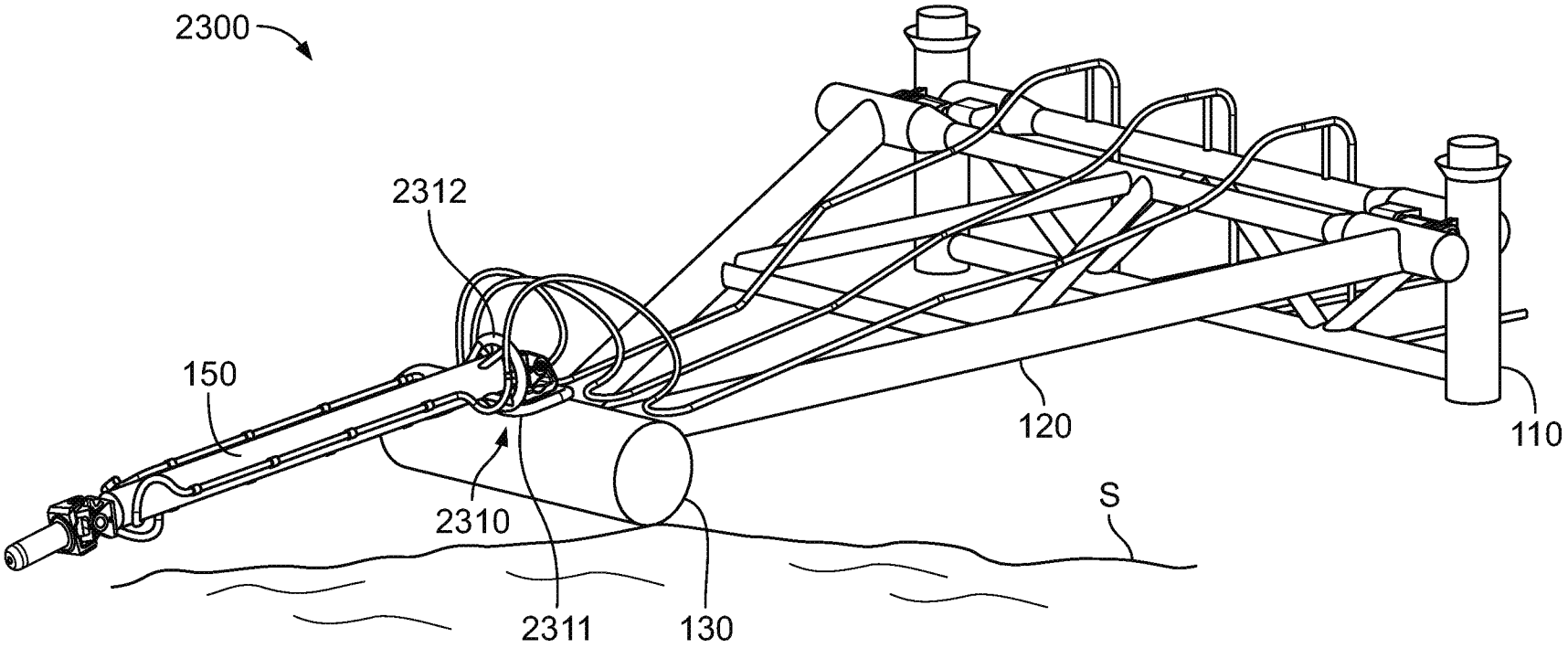
FIGS. 23-25 depict an illustrative mooring system in a disconnected configuration that includes a yoke and a weight laid down on a seabed and a link arm laid down and supported by a contact frame, according to one or more embodiments described.
Figure 24:
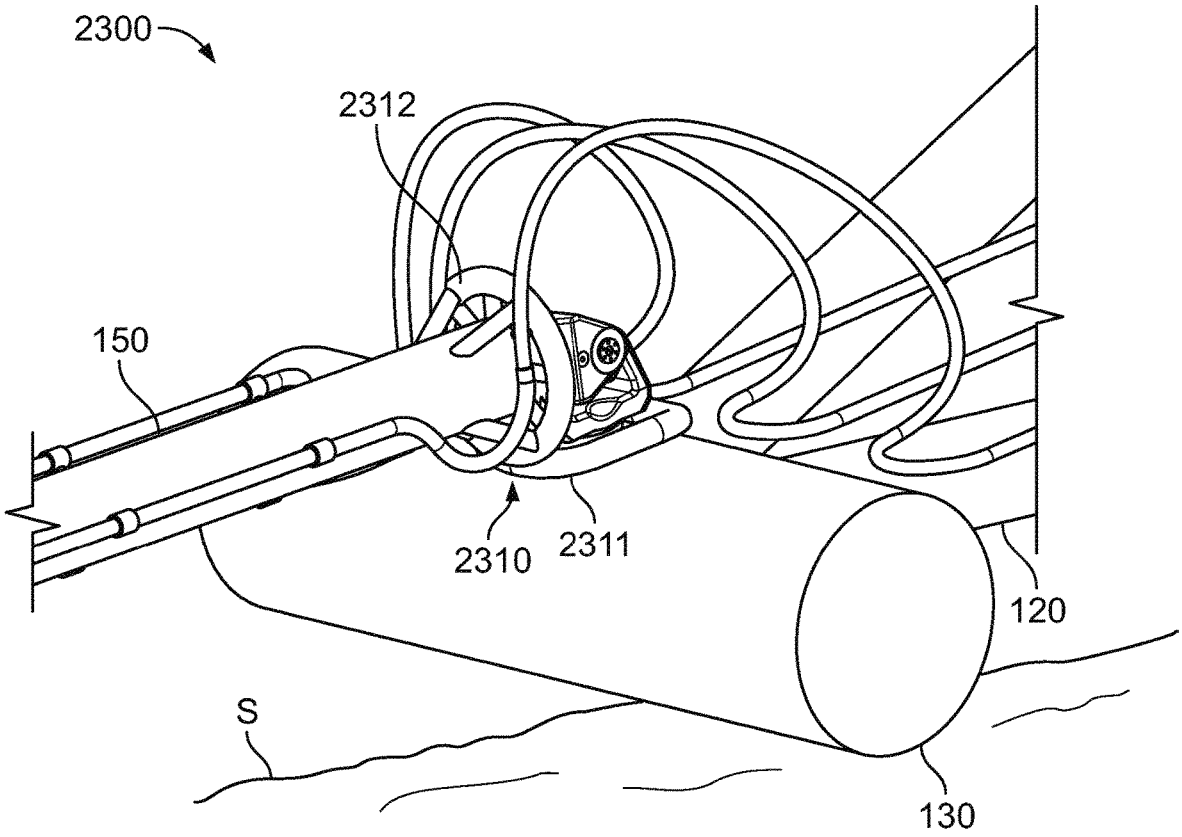
Figure 25:
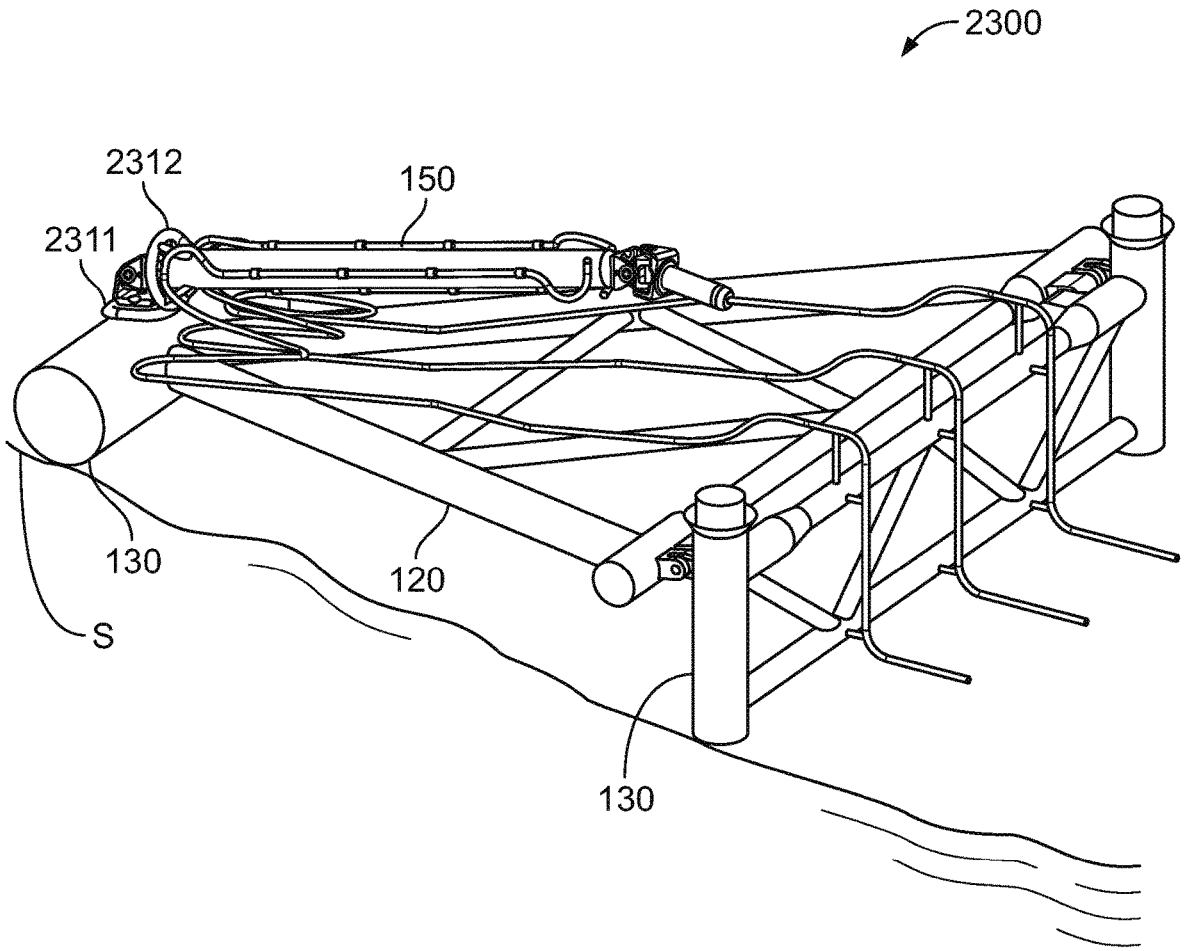

FIGS. 23-25 depict an illustrative mooring system 2300 in a disconnected configuration with the yoke 120 and weight 130 resting on the seabed S and the link arm 150 laid down and supported by a contact frame 2310, according to one or more embodiments. The contact frame 2310 can include a first part 2311 disposed on the yoke 120 and/or the weight 130 and a second part 2312 disposed on the link arm 150. The first part 2311 of the contact frame 2310 and the second part 2312 of the contact frame 2310 can be fabricated structures, e.g., a steel structure. In some embodiments, the first part 2311 of the contact frame 2310 can be fixedly attached to the weight 130 and/or the yoke 120, e.g., by bolting or welding. In other embodiments, the first part 2311 of the contact frame 2310 can be integral with the weight 130 and/or the yoke 120. In some embodiments, the contact frame 2310 can be configured with at least one cushion, not shown, disposed between the first part 2311 and second part 2312 of the contact frame 2310 to minimize shock loading on the contact frame 2310. In some embodiments the second part 2312 of the contact frame 2310 can be fixedly attached to the link arm 150, e.g., by bolting or welding. In other embodiments the second part 2312 of the contact frame 2310 can be integral with the link arm. In some embodiments, the first part 2311 of the contact frame 2310 and the second part 2312 of the contract frame 2310 can be configured, positioned, and/or arranged such that the first part 2311 of the contact frame 2310 contacts and rests on or abuts against, the second part 2311 of the contact frame 2310 such that the link arm can be supported such that the link arm 150 does not contact the seabed S (as shown in FIG. 23) or the yoke 120 (as shown inn FIG. 25). The contact frame 2310 can be configured such that the link arm 150 can be positioned in any number of orientations relative to the weight 1130 and the yoke 120 to provide flexibility as to where the link arm 150 is positioned when the yoke 120 and weight 130 are resting or laid down on the seabed S.

Figure 26:
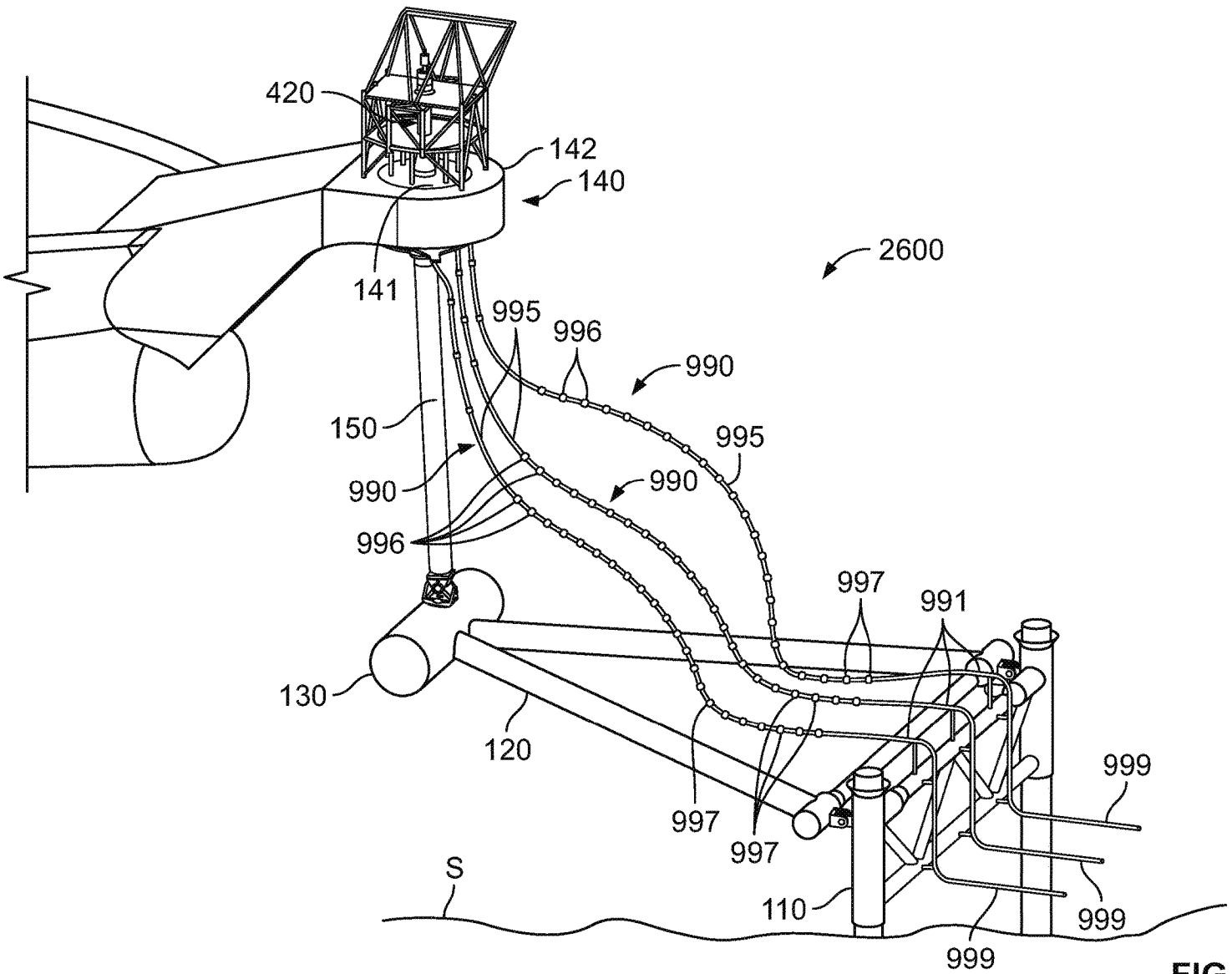
FIG. 26 depicts an isometric view of an illustrative mooring system that includes at least one conduit disposed on the mooring system, according to one or more embodiments described.

FIG. 26 depicts an isometric view of an illustrative mooring system 2600 that includes at least one conduit 990, three are shown, disposed on the mooring system 2600, according to one or more embodiments. The mooring system 2600 can be similar to the mooring system 900 shown in FIG. 9, with the main difference being the conduit(s) 990 can have a different configuration. In some embodiments, the conduit(s) 990 can include a rigid pipe 991 disposed on the base structure 110 and a rigid pipe, not visible, disposed on the fixed part 141 of the turntable 140. The conduit 990 can also include a flexible pipe or hose 995 that can span from the rigid pipe 991 disposed on the base structure 110 to the rigid pipe, not visible, disposed on the fixed part of the turntable 140. The rigid pipe 991 disposed on the base structure 110 can be in fluid communication with pipelines 999 disposed on the seabed S. The flexible pipe or hose 995 spanning from the rigid pipe 991 disposed on the base structure 110 can be configured to have sufficient slack and/or compliance to maintain fluid communication between the rigid pipe 991 on the base structure 110 and the rigid pipe, not visible, disposed on the fixed part 141 of the turntable 140, as the link arm 150 and the yoke 120 pivot relative to one another and/or as the yoke 120 pivots relative to the base structure 110.

In some embodiments, the flexible pipe or hose 995 can include one or more buoyancy modules 996 and/or one or more weight modules 997 distributed along the length of the flexible pipe or hose 995 to configure the flexible pipe or hose 995 to float at a neutral position and in a compliant shape below the surface of the body of water. In some embodiments, the rigid pipe, not visible, can be configured with valves and/or quick connect/disconnect fittings so as to facilitate rapid disconnection of the flexible pipe or hose 995 from the rigid pipe.

The present disclosure further relates to any one or more of the following numbered embodiments:

1. A mooring system for mooring a vessel floating on a surface of a body of water, comprising: a base structure configured to be secured to a seabed; a yoke comprising a first end and a second end, wherein the first end of the yoke is configured to be connected to the base structure such that the yoke is pivotable about an axis of the base structure; a weight connected to the yoke; a turntable comprising a rotating part and a fixed part, wherein the rotating part is configured to be disposed on the vessel; and a link arm comprising a first end and a second end, wherein the first end of the link arm is configured to be connected to the second end of the yoke, the weight, or both the second end of the yoke and the weight, and wherein the second end of the link arm is configured to be connected to the fixed part of the turntable such that the vessel is rotatable with respect to the link arm about a central axis of the turntable.

2. The mooring system of paragraph 1, wherein the yoke and weight are configured to be disposed below the surface of the body of water.

3. The mooring system of paragraph 1 or 2, wherein the axis of the base structure is substantially orthogonal to a longitudinal axis of the yoke.

4. The mooring system of any one of paragraphs 1 to 3, wherein the first end of the yoke is configured to be connected to the base structure such that the yoke does not pivot about a vertical axis of the base structure.

5. The mooring system of any one of paragraphs 1 to 4, wherein the first end of the yoke is configured to be connected to the base structure such that the yoke does not pivot about a longitudinal axis of the yoke that is perpendicular to the axis of the base structure.

6. The mooring system of any one of paragraphs 1 to 5, wherein the weight is disposed toward the second end of the yoke.

7. The mooring system of any one of paragraphs 1 to 6, wherein the first end of the link arm and the second end of the yoke, the weight, or both the second end of the yoke and the weight are configured to be connected via a dual axis joint.

8. The mooring system of any one of paragraphs 1 to 7, wherein the first end of the link arm and the second end of the yoke, the weight, or both the second end of the yoke and the weight are configured to be connected via a dual axis joint such that the link arm is configured to pivot relative to the second end of the yoke about two axes that are substantially orthogonal to one another.

9. The mooring system of any one of paragraphs 1 to 8, wherein the second end of the link arm and the fixed part of the turntable are configured to be connected via a dual axis joint.

10. The mooring system of any one of paragraphs 1 to 9, wherein the second end of the link arm and the fixed part of the turntable are configured to be connected via a dual axis joint such that the link arm is configured to pivot relative to the fixed part of the turntable about two axes that are substantially orthogonal to one another.

11. The mooring system of any one of paragraphs 1 to 10, further comprising a swivel comprising a fixed part connected to the fixed part of the turntable and a rotatable part connected to the rotatable part of the turntable, wherein the swivel is configured to maintain communication between a first conduit disposed on the fixed part of the turntable and a second conduit disposed on the rotating part of the turntable as the vessel rotates about the central axis of the turntable.

12. The mooring system of paragraph 11, wherein the swivel is a fluid swivel, the first conduit is a first fluid conduit in communication with a pipeline disposed on the seabed, and the second conduit is a second fluid conduit.

13. The mooring system of paragraph 12, wherein the first fluid conduit comprises a rigid conduit disposed on the fixed part of the turntable, a flexible conduit, and a rigid conduit disposed on the base structure, wherein the flexible conduit is configured to maintain fluid communication between the rigid conduit disposed on the fixed part of the turntable and the rigid conduit disposed on the base structure as the link arm pivots relative to the yoke and/or as the yoke pivots relative to the base structure.

14. The mooring system of any one of paragraphs 1 to 13, further comprising: a releasable connector comprising a first component connected to the fixed part of the turntable and a second component connected to the second end of the link arm; a lifting device configured to be disposed on the vessel, the lifting device configured to lift and lower the link arm, the weight, and the yoke; and a lifting line, wherein a first end of the lifting line is configured to be connected to the second component of the connector and a second end of the lifting line is configured to be connected to the lifting device.

15. The mooring system of paragraphs 14, wherein the yoke and the weight are configured to be laid on the seabed when the link arm is disconnected from the turntable.

16. The mooring system of paragraph 14 or paragraph 15, wherein the system further comprises a cradle or a contact frame configured to support the link arm when the link arm is disconnected from the turntable.

17. The mooring system of any one of paragraphs 14 to 16, wherein the lifting device comprises a chain jack, a strand jack, a linear winch, a rotary winch, or a combination thereof.

18. The mooring system of any one of paragraphs 14 to 17, wherein the lifting device is electrically driven, hydraulically driven, pneumatically driven, driven via an internal combustion engine, or a combination thereof.

19. The mooring system of any one of paragraphs 1 to 18, further comprising a buoyancy module disposed on the yoke, the weight, or both the yoke and the weight and a transfer conduit configured to convey a gas, a liquid, or a combination thereof into and out of an internal volume of the buoyancy module.

20. The mooring system of paragraph 19, further comprising a compressor or a pump configured to be in fluid communication with the transfer conduit.

21. The mooring system of paragraph 19 or paragraph 20, wherein the internal volume of the buoyancy module is in fluid communication with the body of water such that the internal volume of the buoyancy module comprises a portion of the body of water, and wherein, when the gas and/or liquid is conveyed into the internal volume of the buoyancy module, at least a portion of the water in the buoyancy module is displaced into the body of water.

22. The mooring system of any one of paragraphs 1 to 21, wherein the weight comprises a ballast tank configured to contain a ballast material.

23. A process for mooring a vessel floating on a surface of a body water to a mooring system, comprising: positioning the vessel near the mooring system, wherein the mooring system comprises: a base structure secured to a seabed; a yoke comprising a first end and a second end, wherein the first end of the yoke is connected to the base structure such that the yoke is pivotable about an axis of the base structure; a weight connected to the yoke; a turntable comprising a rotating part and a fixed part, wherein the rotating part is disposed on the vessel; a link arm comprising a first end and a second end, wherein the first end of the link arm is connected to the second end of the yoke, the weight, or both the second end of the yoke and the weight, a releasable connector comprising a first component connected to the fixed part of the turntable and a second component connected to the second end of the link arm; a lifting device disposed on the vessel; and a lifting line having a first end connected to the second component of the connector; connecting a second end of the lifting line to the lifting device; hauling in the lifting line with the lifting device to lift the link arm, the yoke, and the weight to move the second component of the releasable connector into an engagement position with respect to the first component of the releasable connector; and connecting the first component of the releasable connector to the second component of the releasable connector to secure the vessel to the mooring system.

24. The process of paragraph 23, wherein the mooring system further comprises a buoyancy module, the process further comprising at least partially filling an internal volume of the buoyancy module with a gas.

25. The process of paragraph 23, wherein the mooring system further comprises a buoyancy module, the process further comprising at least partially filling the buoyancy module with a liquid.

26. A process for unmooring a vessel floating on a surface of a body of water from a mooring system, comprising: disconnecting a first component from a second component of a releasable connector, wherein the mooring system comprises: a base structure secured to a seabed, a yoke comprising a first end and a second end, wherein the first end of the yoke is connected to the base structure such that the yoke is pivotable about an axis of the base structure, a weight connected to the yoke, a turntable comprising a rotating part and a fixed part, wherein the rotating part is disposed on the vessel, a link arm comprising a first end and a second end, wherein the first end of the link arm is connected to the second end of the yoke, the weight, or both the second end of the yoke and the weight, the first component of the releasable connector is connected to the fixed part of the turntable and the second component of the releasable connector is connected to the second end of the link arm; a lifting device disposed on the vessel; and a lifting line having a first end connected to the second component of the connector and a second end connected to the lifting device; lowering the link arm, the yoke, and the weight toward the seabed with the lifting line and the lifting device; disconnecting the second end of the lifting line from the lifting device; and maneuvering the vessel away from the mooring system.

27. The process of paragraph 26, further comprising applying a tension to the lifting line with the lifting device to remove at least a portion of a tension load from the releasable connector prior to disconnecting the first component from the second component of the releasable connector.

28. The process of paragraph 26 or paragraph 27, wherein the mooring system further comprises a buoyancy module, the process further comprising at least partially filling an internal volume of the buoyancy module with a gas.

29. The process of paragraph 26 or paragraph 27, wherein the mooring system further comprises a buoyancy module, the process further comprising removing a gas from an internal volume of the buoyancy module.

30. The process of paragraph 29, further comprising filling the internal volume of the buoyancy module with a gas.

31. The process of any one of paragraphs 26 to 30, wherein the tension applied to the lifting line with the lifting device is up to 2 kN.

32. The process of any one of paragraphs 26 to 30, wherein the tension applied to the lifting line with the lifting device is greater than 2 kN to 100 kN.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A mooring system for mooring a vessel floating on a surface of a body of water, comprising:

a base structure configured to be secured to a seabed;

a yoke comprising a first end and a second end, wherein the first end of the yoke is configured to be connected to the base structure such that the yoke is pivotable about an axis of the base structure;

a weight connected to the yoke, a turntable comprising a rotating part and a fixed part, wherein the rotating part is configured to be disposed on the vessel; and a link arm comprising a first end and a second end, wherein the first end of the link arm is configured to be connected to the second end of the yoke, the weight, or both the second end of the yoke and the weight, and wherein the second end of the link arm is configured to be connected to the fixed part of the turntable such that the vessel is capable of unlimited rotation about a central axis of the turntable with respect to the fixed part of the turntable and the link arm.

2. The mooring system of claim 1, wherein the weight comprises a ballast tank configured to contain a ballast material.

3. The mooring system of claim 1, wherein the yoke and weight are configured to be disposed below the surface of the body of water.

4. The mooring system of claim 1, wherein the axis of the base structure is substantially orthogonal or substantially perpendicular to a longitudinal axis of the yoke and substantially parallel with the surface of the body of water.

5. The mooring system of claim 1, wherein the first end of the yoke is configured to be connected to the base structure such that the yoke does not pivot about a vertical axis of the base structure and does not pivot about a longitudinal axis of the yoke that is perpendicular to the axis of the base structure.

6. The mooring system of claim 1, wherein the weight is disposed toward the second end of the yoke.

7. The mooring system of claim 1, wherein:

(i) the first end of the link arm and the second end of the yoke, the weight, or both the second end of the yoke and the weight are configured to be connected via a dual axis joint such that the link arm is configured to pivot relative to the second end of the yoke about two axes that are substantially orthogonal or substantially perpendicular to one another, or (ii) the second end of the link arm and the fixed part of the turntable are configured to be connected via a dual axis joint such that the link arm is configured to pivot relative to the fixed part of the turntable about two axes that are substantially orthogonal to one another.

8. The mooring system of claim 1, wherein the first end of the link arm and the second end of the yoke, the weight, or both the second end of the yoke and the weight are configured to be connected via a dual axis joint and the second end of the link arm and the fixed part of the turntable are configured to be connected via a dual axis joint such that the link arm is configured to pivot relative to the second end of the yoke about two axes that are substantially orthogonal to one another and configured to pivot relative to the fixed part of the turntable about two axes that are substantially orthogonal to one another.

9. The mooring system of claim 1, further comprising a swivel comprising a fixed part connected to the fixed part of the turntable and a rotatable part connected to the rotatable part of the turntable, wherein the swivel is configured to maintain communication between a first conduit disposed on the fixed part of the turntable and a second conduit disposed on the rotating part of the turntable as the vessel rotates about the central axis of the turntable.

10. The system of claim 9, wherein the swivel is a fluid swivel, the first conduit is a first fluid conduit in communication with a pipeline disposed on the seabed, and the second conduit is a second fluid conduit.

11. The system of claim 10, wherein the first fluid conduit comprises a rigid conduit disposed on the fixed part of the turntable, a flexible conduit, and a rigid conduit disposed on the base structure, and wherein the flexible conduit is configured to maintain fluid communication between the rigid conduit disposed on the fixed part of the turntable and the rigid conduit disposed on the base structure as the link arm pivots relative to the yoke and/or as the yoke pivots relative to the base structure.

12. The mooring system of claim 1, further comprising:

a releasable connector comprising a first component connected to the fixed part of the turntable and a second component connected to the second end of the link arm;

a lifting device configured to be disposed on the vessel, the lifting device configured to lift and lower the link arm, the weight, and the yoke; and a lifting line, wherein a first end of the lifting line is configured to be connected to the second component of the connector and a second end of the lifting line is configured to be connected to the lifting device.

13. The mooring system of claim 12, wherein the yoke and the weight are configured to be laid on the seabed when the link arm is disconnected from the turntable.

14. The mooring system of claim 12, wherein the system further comprises a cradle or a contact frame configured to support the link arm when the link arm is disconnected from the turntable.

15. The mooring system of claim 12, wherein the lifting device comprises a chain jack, a strand jack, a linear winch, a rotary winch, or a combination thereof.

16. The mooring system of claim 12, further comprising a buoyancy module disposed on the yoke, the weight, or both the yoke and the weight and a transfer conduit configured to convey a gas, a liquid, or a combination thereof into and out of an internal volume of the buoyancy module, wherein the transfer conduit is configured to be in fluid communication with a gas compressor or a pump.

17. The mooring system of claim 12, further comprising a buoyancy module disposed on the yoke, the weight, or both the yoke and the weight and a transfer conduit configured to convey a gas into and out of an internal volume of the buoyancy module, wherein the transfer conduit is configured to be in fluid communication with a compressed gas source, wherein the internal volume of the buoyancy module is in fluid communication with the body of water such that the internal volume of the buoyancy module comprises a portion of the body of water, and wherein, when the gas is conveyed into the internal volume of the buoyancy module, at least a portion of the water in the buoyancy module is displaced into the body of water.

18. The mooring system of claim 1, wherein:

the first end of the yoke is configured to be connected to the base structure such that the yoke does not pivot about a vertical axis of the base structure and does not pivot about a longitudinal axis of the yoke that is perpendicular to the axis of the base structure, the yoke and weight are configured to be disposed below the surface of the body of water, the first end of the link arm and the second end of the yoke, the weight, or both the second end of the yoke and the weight are configured to be connected via a dual axis joint and the second end of the link arm and the fixed part of the turntable are configured to be connected via a dual axis joint such that the link arm is configured to pivot relative to the second end of the yoke about two axes that are substantially orthogonal to one another and configured to pivot relative to the fixed part of the turntable about two axes that are substantially orthogonal to one another, and the weight comprises a ballast tank configured to contain a ballast material.

19. A process for mooring a vessel floating on a surface of a body water to a mooring system, comprising:

positioning the vessel near the mooring system, wherein the mooring system comprises:

a base structure secured to a seabed;

a yoke comprising a first end and a second end, wherein the first end of the yoke is connected to the base structure such that the yoke is pivotable about an axis of the base structure;

a weight connected to the yoke;

a turntable comprising a rotating part and a fixed part, wherein the rotating part is disposed on the vessel;

a link arm comprising a first end and a second end, wherein the first end of the link arm is connected to the second end of the yoke, the weight, or both the second end of the yoke and the weight, a releasable connector comprising a first component connected to the fixed part of the turntable and a second component connected to the second end of the link arm;

a lifting device disposed on the vessel; and a lifting line having a first end connected to the second component of the connector;

connecting a second end of the lifting line to the lifting device;

hauling in the lifting line with the lifting device to lift the link arm, the yoke, and the weight to move the second component of the releasable connector into an engagement position with respect to the first component of the releasable connector; and connecting the first component of the releasable connector to the second component of the releasable connector to secure the vessel to the mooring system.

20. A process for unmooring a vessel floating on a surface of a body of water from a mooring system, comprising:

disconnecting a first component from a second component of a releasable connector, wherein the mooring system comprises:

a base structure secured to a seabed, a yoke comprising a first end and a second end, wherein the first end of the yoke is connected to the base structure such that the yoke is pivotable about an axis of the base structure, a weight connected to the yoke, a turntable comprising a rotating part and a fixed part, wherein the rotating part is disposed on the vessel, a link arm comprising a first end and a second end, wherein the first end of the link arm is connected to the second end of the yoke, the weight, or both the second end of the yoke and the weight, the first component of the releasable connector is connected to the fixed part of the turntable and the second component of the releasable connector is connected to the second end of the link arm;

a lifting device disposed on the vessel; and a lifting line having a first end connected to the second component of the connector and a second end connected to the lifting device;

lowering the link arm, the yoke, and the weight toward the seabed with the lifting line and the lifting device;

disconnecting the second end of the lifting line from the lifting device; and maneuvering the vessel away from the mooring system.

* * * * *